US011103403B2

(12) United States Patent
Gillespie

(10) Patent No.: US 11,103,403 B2
(45) Date of Patent: Aug. 31, 2021

(54) LIFTING SYSTEM WITH LIFTING DEVICE AND CANTILEVERED SUPPORT PLATFORM

(71) Applicant: Margaret Forshaw Gillespie, Rockdale (AU)

(72) Inventor: Bruce Rome Gillespie, Balmain East (AU)

(73) Assignee: VALLUGA HOLDINGS PTY LTD, North Sydney (AU)

( * ) Notice: Subject to any disclaimer, the term of this patent is extended or adjusted under 35 U.S.C. 154(b) by 0 days.

(21) Appl. No.: 16/345,233

(22) PCT Filed: Oct. 31, 2017

(86) PCT No.: PCT/AU2017/051196

§ 371 (c)(1),
(2) Date: Apr. 25, 2019

(87) PCT Pub. No.: WO2018/076076

PCT Pub. Date: May 3, 2018

(65) Prior Publication Data

US 2020/0146912 A1 May 14, 2020

(30) Foreign Application Priority Data

Oct. 31, 2016 (AU) ..... 2016904439
Jun. 27, 2017 (AU) ..... 2017902474

(51) Int. Cl.

| | |
|---|---|
| ***A61G 7/10*** | (2006.01) |
| ***A61G 1/003*** | (2006.01) |
| ***A61G 1/013*** | (2006.01) |
| ***A61G 1/017*** | (2006.01) |
| ***A61G 7/005*** | (2006.01) |
| ***A61G 7/16*** | (2006.01) |

(Continued)

(52) U.S. Cl.

CPC ..... *A61G 7/1021* (2013.01); *A61G 1/003* (2013.01); *A61G 1/013* (2013.01); *A61G 1/017* (2013.01);

(Continued)

(58) Field of Classification Search

CPC ..... A61G 7/1021; A61G 1/003; A61G 1/013; A61G 1/017; A61G 7/005; A61G 7/1019;

(Continued)

(56) References Cited

U.S. PATENT DOCUMENTS 6,854,137 B2 * 2/2005 Johnson ..... A61G 7/1019 5/81.1 C
7,487,559 B1 * 2/2009 Denosky ..... A61G 7/1025 5/81.1 HS (Continued)

FOREIGN PATENT DOCUMENTS

EP 2415444 2/2012
GB 2381256 A 4/2003

(Continued)

OTHER PUBLICATIONS

International Search Report for International Application No. PCT/AU2017/051196, Date of Filing: Oct. 31, 2017, Applicant: Margaret Forshaw Gillespie, dated Dec. 4, 2017, 4 pages.

(Continued)

*Primary Examiner* — David R Hare
*Assistant Examiner* — Adam C Ortiz
(74) *Attorney, Agent, or Firm* — Perkins Coie LLP

(57) ABSTRACT

A lifting system for lifting a subject (12) supported in a particular position is described. The lifting system has a platform (10) for supporting the subject (12) on an elongate platform surface (101). The platform surface (101) is selectively configurable in a flexible state allowing the elongate platform (10) to fold along a longitudinal line for positioning beneath the subject (12), and a rigid state to support the subject (12) in the desired position. The platform also has one or more attachment structures (16) and, the lifting system has a lifting device (26) for detachably engaging (18) the one or more attachment structures (16) to elevate and (Continued)

lower the platform (10) cantilevered from the lifting device (26).

12 Claims, 23 Drawing Sheets

(52) U.S. Cl.
CPC ..... *A61G 7/005* (2013.01); *A61G 7/1019* (2013.01); *A61G 7/1088* (2013.01); *A61G 7/1096* (2013.01); *A61G 7/16* (2013.01); *A61G 7/1046* (2013.01); *A61G 2203/14* (2013.01); *A61G 2203/18* (2013.01)

(58) Field of Classification Search
CPC ..... A61G 7/1088; A61G 7/1096; A61G 7/16; A61G 2203/14; A61G 2203/18
See application file for complete search history.

(56) References Cited

U.S. PATENT DOCUMENTS

| | | | | |
|---|---|---|---|---|
| 2001/0044966 | A1 | 11/2001 | Linger et al. | |
| 2005/0135907 | A1 | 6/2005 | Romano et al. | |
| 2006/0218724 | A1 | 10/2006 | Blevins | |
| 2009/0276955 | A1 | 11/2009 | Palay et al. | |
| 2012/0023660 | A1* | 2/2012 | Ota | A61G 7/1019 5/81.1 R |
| 2016/0057971 | A1* | 3/2016 | Jenkins | A01K 1/0157 |

FOREIGN PATENT DOCUMENTS

| | | |
|---|---|---|
| GB | 2529954 | 3/2016 |
| WO | WO2012001423 | 1/2012 |

OTHER PUBLICATIONS

Written Opinion for International Application No. PCT/AU2017/051196, Date of Filing: Oct. 31, 2017, Applicant: Margaret Forshaw Gillespie, dated Dec. 4, 2017, 6 pages.
International Preliminary Report on Patentability for International Application No. PCT/AU2017/051196, Date of Filing: Oct. 31, 2017, Applicant: Margaret Forshaw Gillespie, dated Oct. 31, 2018, 17 pages.
Supplementary Partial European Search Report received for copending European Patent Application No. EP17865915, Date of Completion of Search: Aug. 7, 2019, 8 pages.

* cited by examiner

LIFTING SYSTEM WITH LIFTING DEVICE AND CANTILEVERED SUPPORT PLATFORM

FIELD

The present invention relates to a lifting system and a method of lifting a subject or an object on a support platform cantilevered from a lifting device. In some embodiments, the present invention relates to a selectively reconfigurable support platform, such as an inflatable mattress, and a lifting device for lifting a patient.

BACKGROUND

Moving subjects between a first location (e.g. a bed or the ground) and a second location (e.g. a surgical table, a gurney, etc.) is difficult when the subject is incapacitated. This is particularly the case for elderly people, sick people, unconscious people and injured people. Furthermore, the same difficulties can also apply for moving animals. These subjects are able to offer little assistance to those attempting to move them. Furthermore, the subject may require delicate movement to prevent injury.

Lifting of subjects is typically carried out using manual techniques, such as two person lifts of a patient which may include the use of assistive devices such as a belt attached to the subject with handles to allow the assistants to obtain a better grip of the subject, or a patient handling sling, or by the use of mechanical devices such as floor mounted crane type hoists or ceiling mounted hoists. All are characterized by a requirement of close contact with the subject either by the assistant or the devices. Whilst there is variability from one subject to the next, there is generally considerable effort required of the assistants, a loss of dignity and a feeling of insecurity felt by the subject.

Movement of subjects therefore presents serious occupational health and safety risks to persons tasked with moving the subject, including, for example, nurses, orderlies, ambulance officers, veterinaries, wildlife officers, etc. Such occupational health and safety risks include back strain and other injuries. Additional staffing may be required to move subjects to avoid injury.

It is therefore desirable to provide a device that allows for the safe lifting of subjects, as well as a feeling of security and dignity to the subject.

Reference to any prior art in this specification is not, and should not be taken as, an acknowledgment or any form of suggestion that this prior art forms part of the common general knowledge in any country.

SUMMARY

A first aspect of the present invention provides a lifting system for lifting a subject supported in a desired position, the lifting system comprising:

a platform for supporting the subject, the platform having an elongate platform surface selectively configurable in a flexible state allowing the elongate platform surface to fold about a longitudinal line for positioning the platform beneath the subject, and a rigid state to support the subject in the desired position, the platform also having one or more attachment structures; and, a lifting device for detachably engaging the one or more attachment structures to elevate and lower the platform cantilevered from the lifting device.

Preferably, the platform has at least one inflatable compartment such that the platform surface is in the flexible state when the platform is deflated and in the rigid state when the platform is inflated.

Preferably, the platform has support elements that are each configured to selectively engage with at least one of the other support elements when the platform surface is in the rigid state to structurally strengthen the platform, and disengage when the platform surface is in the flexible state such that the support elements are movable relative to each other.

Preferably, relative movement of the support elements causes the platform to change between the flexible state and the rigid state.

Preferably, one or more of the support elements are within one of the inflatable compartments.

Preferably, the lifting device has at least one cantilevered tyne for sliding engagement in the attachment structures of the platform. In a further preferred form, the lifting device has a plurality of spaced cantilevered tynes, wherein the tynes are selectively lockable in fixed positions relative to each other, and movable to change positions relative to each other.

Preferably, the lifting device has four tynes and the platform has a backrest portion, a seat portion and a leg rest portion, wherein the backrest portion extends between two of the four tynes when engaged with the lifting device, the leg rest portion extends between the remaining two tynes, and the seat portion extends between the back rest and the leg rest, such that during use the back rest, seat portion and leg rest are angularly displaceable relative to each other by relative movement of the four tynes.

Preferably, the seat portion incorporates an opening for toileting. In some embodiments, the seat portion has saddle contouring for supporting the subject as the lifting device reconfigures the platform towards an upright orientation.

Preferably, the inflatable compartments are formed from drop stitch material with a woven top layer overlaying a woven bottom layer with a multitude of interconnecting threads of predetermined length sandwiched between the top layer and the bottom layer, and a gas impermeable skin bonded to the outer surfaces of the top and bottom layers, the skin also forming side walls of a height generally corresponding to the length of the interconnecting threads such that inflation of the inflatable compartments rigidly fixes the top layer relative to the bottom layer in accordance with the lengths of the interconnecting threads.

Preferably, the lifting device has ground supports configurable for movement across varying floor surfaces. In a further preferred form, the lifting device does not obstruct movement of the subject's feet when in contact with the ground.

In preferred embodiments, the lifting device is powered and has a control interface for operative control of the platform. Preferably, the operative control of the platform includes selectively switching between the flexible state and the rigid state.

In some preferred embodiment, the control interface provides operative control of the inflation and deflation of each compartment in the platform.

Optionally, the lifting device is alternatively or additionally controlled by a remote device. In some forms, the remote device is a hand held smart device with a touch screen.

Optionally, the lifting device is alternatively or additionally controlled by technology developed for people with disabilities. Preferably the technology accepts user inputs including one or more of the following:

eye gaze,
breath control,
voice recognition, and
joystick manipulation.

In another aspect, the invention provides a lifting device for use in the lifting system described above. Similarly, another aspect of the invention provides a platform for use in the lifting system described above.

Particular embodiments of the invention provide an inflatable mattress switchable between a deflated state and an inflated state, the mattress comprising a channel into which a support element may be inserted, wherein insertion of the support element reinforces the mattress in the inflated state when the mattress bears a weight thereon.

Inflation of the mattress can expose the channel and allow the support element to be readily inserted therein. As the mattress is reinforced by the support element, the mattress itself may be manufactured without rigid support components. In some embodiments, this can assist in safely placing a subject on the mattress. Furthermore, use of the mattress in conjunction with the support element allows for safe lifting of a subject on the mattress as the support element reinforces the mattress.

The term "reinforce" as used herein in relation to the use of a support element in a channel of the mattress should be understood to mean that the support element confers strength to the mattress when the mattress bears a weight thereon. The support element may confer strength to the mattress by, for example; distributing the weight on the mattress over a larger surface area of the mattress; bearing some of the weight on the mattress; transferring some of the weight from on the mattress; increasing the rigidity of the mattress; and/or preventing or reducing unwarranted deformation of the mattress.

In some embodiments, the support element reinforces the mattress when the mattress is inflated and lifted with a weight thereon.

In some embodiments, the mattress comprises a plurality of channels into which support elements may be inserted.

In some embodiments, when the mattress is inflated, the mattress is adjustable between an unbent configuration and a bent configuration or between different bent configurations via one or more inserted support elements.

The weight on the mattress may comprise a subject (e.g. an animal or human) or an inanimate object (e.g. a vehicle, goods, building materials, etc.). In this regard, the mattress may be sized and shaped according to the desired weight thereon.

A related aspect of the invention provides a method of lifting a subject supported in a desired position, the method comprising:

providing a platform for supporting the subject, the platform having one or more attachment structures and an elongate platform surface selectively configurable in a flexible state allowing the elongate platform surface to fold about a longitudinal line, a rigid state to support the subject in the desired position;

positioning the subject to lie on one side;

positioning the platform in a flexible state alongside the subject such that the fold is closely adjacent the subject's back;

rolling the subject to their opposing side onto the platform surface;

unfolding the platform surface such that the platform surface extends beneath the subject;

configuring the platform surface into the rigid state; and, providing a lifting device for detachably engaging the one or more attachment structures to elevate and lower the platform cantilevered from the lifting device.

Another aspect of the invention provides a lifting system comprising: the mattress of the first aspect of the invention; and one or more support elements, wherein the one or more support elements are insertable into the one or more channels of the inflated mattress to reinforce the inflated mattress when the mattress is inflated and bears a weight thereon.

The support elements may be sized, shaped and weight rated according to the weight to be lifted on the mattress and the size, shape and configuration of the mattress itself.

A related aspect of the invention provides a method for lifting a subject or an object, the method comprising: inflating a deflated mattress as described above on which the subject or object is resting; inserting one or more support elements into the one or more channels of the inflated mattress; and lifting the inflated mattress; wherein the one or more support elements reinforce the inflated mattress when the mattress is lifted.

For ease of reference, the inflatable mattress will be described herein as having a longitudinal dimension (or length) and a lateral dimension (or width). It will be appreciated that the term "substantially longitudinal" in relation to the mattress means at an angle ranging from 0° to 45° to the longitudinal axis of the mattress. It will also be appreciated that the term "substantially lateral" in relation to the mattress means at an angle ranging from 0° to 45° to the lateral axis of the mattress.

DESCRIPTION OF EXEMPLARY EMBODIMENTS

It is to be understood that the following description is for the purpose of describing particular embodiments only and is not intended to be limiting with respect to the above description.

A first aspect of the present invention provides an inflatable mattress switchable between a deflated state and an inflated state, the mattress comprising a channel into which a support element may be inserted, wherein insertion of the support element reinforces the mattress in the inflated state when the mattress bears a weight thereon.

It will be appreciated by those skilled in the art that the inflatable mattress may take any one of a range of different sizes and shapes. In some embodiments, the inflatable mattress is generally elongate and sized for a person to lie on. In some embodiments, the inflatable mattress will be generally elongate but sized and shaped to fit in a chair or a wheelchair. In other embodiments, the elongate mattress may be sized and shaped to accommodate a vehicle, building materials or other objects. The mattress may be 2-dimensionally or 3-dimensionally contoured, or substantially flat, when inflated.

The term "deflated" as used herein in relation to the inflatable mattress is intended to mean that the mattress is substantially devoid of a volume of air. In contrast, the term "inflated" as used herein in relation to the inflatable mattress is intended to mean that the mattress contains a substantial volume of air and may be used to refer to a completely inflated or a semi-inflated mattress, and will typically contain a volume of air which is at a higher pressure than the surrounding ambient air pressure. A typical inflatable mattress will have opposed top and bottom walls bounded by side walls. In the deflated state, the opposed top and bottom walls may contact each other as the mattress is substantially devoid of a volume of air (i.e. there is no or little air pressure on the walls of the mattress to keep the top and bottom walls apart). In this state, the mattress can be folded (or rolled, or concertinaed, whichever is convenient) about a longitudinal line so that the patient support surface is partially overlaying on itself. The patient (usually laying flat on a bed) is rolled onto one side and the folded, deflated mattress is placed along-side with its longitudinal foldline adjacent the length of the patent. Gently rolling the patent onto the opposite side allows the folded edge of deflated mattress to be unfurled so that the patient can roll back to lie completely on its top surface.

In the inflated state, the air pressure in the mattress separates the top and bottom walls to support the patient with a cushion of air. The amount of internal air pressure will depend on whether the mattress is semi-inflated or completely inflated.

In semi-inflated states, the air pressure on the walls is reduced (compared to the completely inflated mattress) and if an external local or distributed inwardly acting force is applied to the walls of the mattress, the walls of the mattress may deform (i.e. the top and bottom walls may be forced together).

While 'air' is a suitable medium for the purposes of inflating the mattress, it will be appreciated that other suitable gases could be employed for the same purpose, such as, for example, carbon dioxide.

The mattress may be inflated by forcing air into the mattress through an air inlet on the mattress. The mattress may be deflated by allowing the air inside the mattress to escape through an air outlet on the mattress. In some embodiments, the air outlet may also be the air inlet. The mattress may be self-inflating (e.g. via a self-contained pierceable air or carbon-dioxide canister) or compressed air may be pumped through the air inlet (e.g. by an air compressor, a compressed air storage cylinder, or by mouth blowing of air). In some embodiments, the air inlet may comprise an aperture, which can be sealed using a plug or the air inlet may comprise a valve. Appropriate plugs and valves for inflatable mattresses are known in the art.

The inflatable mattress may comprise compartments defined by inner mattress walls. The compartments may be in fluid communication with each other, thereby allowing the compartments to be inflated together (i.e. a single air inlet may be used to inflate all the compartments). Alternatively, the compartments may be sealed from each other and each compartment may include separate air inlets for inflation. In embodiments in which the mattress includes separately inflatable compartments, the different compartments may be inflated to different air pressures. The compartments may be uniform in size and/or distribution. Alternatively, some compartments may be larger than others and/or compartments may be stacked on top of each other. For example, a mattress may comprise larger compartments or more compartments around its side walls to provide a raised boundary when inflated. Such a mattress may be useful in retaining objects or subjects on the mattress.

A range of configurations and sizes of compartments may be used. In some embodiments, the inflatable mattress may comprise a plurality of substantially longitudinal inflatable compartments, a plurality of substantially lateral inflatable compartments or a combination of substantially longitudinal inflatable compartments and substantially lateral inflatable compartments. The compartments may be used to increase the rigidity to the mattress when inflated.

In some embodiments, the mattress is semi-rigid when inflated. The semi-rigidity may be provided by inflatable compartments. Alternatively, the semi-rigidity may be a result of air pressure to which the mattress is inflated and/or a result of the composition of the mattress. The term "semi-rigid" as used herein in relation to the mattress is intended to mean that the mattress resists bending in a longitudinal or a lateral plane unless a sufficient force is applied to the mattress.

The mattress may comprise a resilient material. Such mattresses allow a degree of expansion upon inflation and/or can permit a degree of bending. In some embodiments, the mattress is made from rubber or plastic including, for example, polyvinylchloride (PVC), rubberized nylon, rubberized rayon, rubberized fabric, PVC-f used materials such as rayon or fabric, and the like. In some embodiments, different parts of the mattress may be made from different materials to facilitate stretching and/or compression of the different parts of the mattress upon bending. Heavy duty materials, for example a woven aramid fibre such as Kevlar, may be used for embodiments in which heavy loads are expected.

In some embodiments, the mattress may contain compartments with differential air pressures, across the depth of the mattress or in specific locations to improve the structural performance or other characteristics of the mattress in the inflated state.

In some embodiments, the compartments may be used to create a zone in a top section of the mattress which provides a layer that substantially resists compression and a zone in a bottom section which provides a tensile layer, similar to the flanges on a steel "I" beam. The creation of such zones in the mattress can improve the strength of the mattress and can aid in the controlled bending of the mattress.

As one or more support elements may be inserted into the inflated mattress to reinforce the mattress, the mattress itself doesn't require rigid components (although in some embodiments the mattress may comprise rigid components). In this regard, in some embodiments, the mattress may be rolled or folded when deflated. In some embodiments, the configuration of compartments can assist in the rolling or folding of the deflated mattress (e.g. a longitudinal configuration of compartments assists in the longitudinal rolling or folding of the mattress). The ability to roll or fold the mattress can allow the mattress to be stored in a compact form and can also be useful in placing patients on the deflated mattress (as will be described later).

As described above, the mattress according to the first aspect of the invention includes a channel into which a support element may be inserted. The insertion of the support element reinforces the mattress when the mattress is inflated and bears a weight thereon. In some embodiments, the mattress may comprise a plurality of channels into which support elements may be inserted.

While the support element(s) may be inserted into the channel(s) when the mattress is in the deflated state, in most instances it will be preferable to insert the support element(s) into the channel(s) when the mattress is in the inflated state. By inflating the mattress prior to inserting the support element(s) into the channel(s), the entries to the channel(s) may be better exposed and/or better defined i.e. the top and bottom walls of the mattress will not be in contact—which would otherwise obscure the entries to the channel(s).

As described above, the support element(s) may reinforce the mattress by, for example: distributing the weight on the mattress over a larger surface area of the mattress; bearing some of the weight on the mattress; transferring some of the weight from on the mattress; increasing the rigidity of the mattress; and/or preventing or reducing unwarranted deformation of the mattress. While it is envisaged that the mattress will be maintained in the inflated state for the duration in which the support element(s) are in the channel(s), some embodiments may allow the mattress to be deflated with the support element(s) still reinforcing the mattress bearing the weight. For example, the mattress may be inflated to raise a patient to allow the support element(s) to be inserted, and then the mattress may be deflated such that the patient rests on the support element(s). This may be performed for injuries where it is desirable to move the patient onto a transfer apparatus with minimal movement of the patient, yet still transport the patient on a rigid surface.

In some embodiments, the mattress becomes a tension structure once the support elements have been inserted. In these embodiments, as the tension of the mattress between the support elements may sufficiently reinforce the mattress to support a weight thereon, the mattress may be deflated once the support elements have been inserted. In some embodiments, the one or more channels may not run entirely through the mattress (i.e. the channels may only have one open end). In these embodiments, it is desirable that the channels are deep enough to accommodate support elements that adequately support a weight on the mattress. In this regard, it is generally desirable that the one or more channels run at least half the length or width of the mattress.

The support element(s) may be completely contained with the channel(s). In these embodiments, the mattress may be lifted by handles provided by or attached to the mattress. Alternatively, an end of each support element may protrude from the channel. In this regard, the end of the support element(s) may also act as a handle for lifting the mattress.

In other embodiments, the one or more channels form one or more holes through the mattress (i.e. each channel has two or more open ends). In this regard, support element(s) that at least span the width or the length of the mattress may be inserted into the channel(s). This arrangement allows both ends of each support element to protrude from the channel(s), thereby allowing the mattress to be lifted via the one or more support elements.

In some embodiments, the one or more channels may run substantially longitudinally in relation to the mattress or substantially laterally in relation to the mattress. In some embodiments, the mattress may include channels that run substantially longitudinally in relation to the mattress and channels that run substantially laterally in relation to the mattress. In this regard, some mattresses may include channels that intersect or cross over with other channels.

In some embodiments, all the channels run substantially longitudinally in relation to the mattress or all the channels run substantially laterally in relation to the mattress. In these embodiments, it may be advantageous for the mattress to include compartments, as described above, which run perpendicular to the channels to further reinforce the mattress. Such compartments can make the mattress semi-rigid between the channels.

In some embodiments, when the mattress is inflated, the mattress is adjustable between an unbent configuration and a bent configuration or between two different bent configurations via one or more inserted support elements. As described above, in some embodiments, the inflated mattress may be substantially flat or 2-dimensionally or 3-dimensionally contoured. In this regard, the term "unbent configuration" as used herein in relation to the inflated mattress is intended to mean the normal inflated configuration of the mattress (i.e. the configuration when a bending force has not been applied to the inflated mattress). Accordingly, the term "bent configuration" as used herein in relation to the inflated mattress is intended to mean a configuration that is different to the normal inflated configuration as a result of the application of a bending force to the inflated mattress.

In some embodiments, the mattress may be adjusted between the unbent configuration and a bent configuration by insertion of one or more curved support elements. Preferably, such a curved support element will have a gentle curve to still permit easy insertion of the support element into the channel. For example, inserting a support element with a gentle curve can be used to adjust the inflated mattress from a flat configuration to a curved configuration. Such a curved configuration may assist in retaining a patient on the mattress by raising the height of the edges of the mattress. In some embodiments, the channel may also be configured to more readily receive a bent support element (i.e. the channel itself may be curved).

In some embodiments, the support elements may be hinged to adjust the mattress between an unbent configuration and a bent configuration and/or to assist in the lifting of the mattress. For example, a support element with two hinges may be adjusted by the hinges such that the support element has a middle substantially horizontal portion and two angled end portions. Once inserted into the channel, the two angled portions may be located within the channel in which case the mattress will bend when the support element is adjusted by the hinges such that the mattress will have a middle substantially horizontal middle portion and two angled end portions. In this regard, the edges of the mattress may be raised, which can be useful in retaining objects or subjects on the mattress. Alternatively, the hinges of the support element may be such that they are located outside the channel and allow the support element to bend upwards. This can assist in the lifting and lowering of the mattress, especially from/to the ground or low locations that may otherwise require people lifting the mattress to bend while supporting the weight of the mattress.

In other embodiments, the mattress may be adjustable between an unbent configuration and a bent configuration by moving a first inserted support element relative to a second inserted support element.

In some embodiments, the bent configuration may comprise multiple bends. The multiple bends may be obtained, for example, by relative movement of a first support element, a second support element and a third support element. In this regard, the configuration of the mattress may be adjusted to suit different purposes. For example, the mattress may be used to adjust a patient on the mattress from a lying position to a seated or semi-reclined position or to raise and better support the patient's legs.

As the inflated mattress will comprise less air volume directly above and below the channels, and the channels themselves are not pressurized with air, the channels provide ideal pivot points for the mattress to bend when support elements are inserted into the channels i.e. bending the mattress along a channel with a support element therein requires less displacement of air from above or below the channel to other parts of the mattress. Furthermore, the support element in the channel is able to react the force applied to the bend in the mattress.

As described above, the support element(s) inserted into the channel(s) reinforce the mattress when the mattress bears a weight thereon. The source of the weight may come in many forms. For example, the weight may comprise an inanimate object including, for example, a vehicle, goods, building materials or any other objects that may be desired to be lifted, moved or supported on the mattress. While the weight may comprise an inanimate object, in most embodiments the mattress may be used for animals or humans and the weight comprises respectively an animal or a human subject.

In embodiments wherein the weight comprises an animal, it is envisaged that the animal will be relatively large. The animal may include, for example, mammalian subjects such as primates, livestock animals such as horses, cattle, sheep, pigs, goats or the like, companion animals such as dogs, or animals of veterinary significance, or animals of economic significance. The subject may also include non-mammalian animal subjects such as reptilian animals, large birds and fish.

In some embodiments wherein the weight comprises a human, the human may be a human capable of only limited movement. For example, the human may be elderly, disabled, injured or sick. Thus, embodiments of the invention are particularly suitable for use in, for example, hospitals, nursing homes, ambulances, rescue services, and at sporting events (e.g. for injured players).

In some embodiments, the mattress may be used to assist in the transfer of a wheelchair bound person from the wheelchair to a bed or a seat including, for example, a seat in a car or an aircraft. In these embodiments, the mattress (sized to fit in a wheelchair) may be placed under the person in the wheelchair. When it is desired to move the person, the mattress is inflated and support elements inserted into the channels. The mattress with the person thereon may be lifted via the support elements and placed on the seat in the car or aircraft. The support elements may then be removed and optionally the mattress may be deflated. Use of the mattress in this manner, can simplify the transfer of wheelchair bound persons and avoid the need for the person to lift themselves in public to allow a transfer seat to be placed under them.

As can be appreciated, the mattress may also be used to transfer mobility impaired persons who are not wheelchair bound from a first seat to a second seat as described above.

As the mattress is inflatable, aquatic applications are also envisaged. For example, the mattress may be used as a floatable platform for bearing a subject or an object thereon. Support elements may be inserted to reinforce the mattress and may also be used to assist in moving the mattress (e.g. when the mattress is lifted or towed). In some embodiments, the mattress in a deflated state may be placed under an underwater object and inflated e.g. by use of a compressed air storage cylinder or a compressed air feed line from an air compressor on a boat. The inflation of the mattress may be sufficient to raise the mattress with the object thereon to the water surface. Support elements may then be inserted to reinforce the mattress and the mattress lifted from the water with the object thereon or moved along the surface of the water e.g. towed by a boat. Alternatively, the support elements may be inserted into the inflated mattress underwater to reinforce the mattress with the object thereon and the inflated mattress lifted to the surface of the water via the inserted support elements or other handles provided on the mattress.

Another aspect of the invention provides a lifting system comprising: the mattress as described above; and one or more support elements, wherein the one or more support elements are insertable into the one or more channels of the inflated mattress to reinforce the inflated mattress when the mattress is inflated and bears a weight thereon.

In some embodiments, the support elements are shaped to fit snugly within the channels. For example, when cylindrical support elements are used, the support elements may have a diameter which is approximately the same diameter as the channels when the mattress is inflated. In other embodiments, the support elements are shaped simply to fit in or through the channels (i.e. the support elements may have a smaller diameter or even a different cross-sectional shape compared to the channels when the mattress is inflated). In these embodiments, the support elements may reinforce the mattress when the mattress is lifted with the weight thereon.

In some embodiments, the one or more support elements are longer than one or more channels, which form one or more holes through the mattress, such that one or both ends of the one or more support elements projects from the one or more channels. In this regard, the mattress with a weight thereon may be lifted via the one or more support elements. Different support elements may be used depending on the size of the mattress, the purpose of the mattress, the size of the channels and the number of channels. For example, the mattress may comprise a single wide channel running the length of the mattress and the support element may be provided by a plank which is inserted into the channel. In other embodiments, the mattress may comprise tubular channels (of circular or other shaped cross-sections) and the support elements may comprise poles.

In some embodiments, the support elements may be rigid support elements that are straight or curved. In other embodiments, the support elements may be flexible (i.e. the support elements may be provided by cables, ropes or the like). In these embodiments, the support elements may reinforce the mattress when the cables or ropes are pulled taut. In some embodiments, the support elements may be hinged, for example, as described previously herein.

In some embodiments, the support elements may comprise handles or lifting members (e.g. lifting eyes, cleats, etc.) on one or both ends. The handles or lifting members may be integral to the support element or may be attachable to the support element. In embodiments whereby the handles or lifting members are integral to the support elements, at least one handle or lifting member should be sized to permit insertion in a channel of the mattress. Handles or lifting members which are too large to allow insertion of the support element in a channel of the mattress should either be removable from the support element or only provided on one end of the support element. Such handles or lifting members may be used to prevent unwarranted removal of the support element from the mattress.

Removable handles or lifting members may be attached to the support element by methods known in the art including, for example, threaded engagement, clamping, interlocking, cord-ties, etc.

In some embodiments, the lifting system includes an inflated mattress which is adjustable between an unbent configuration and a bent configuration or between two different bent configurations via one or more inserted support elements. As discussed previously herein, the mattress may be adjustable between an unbent configuration and a bent configuration or between two different bent configurations by insertion of one or more curved or hinged support elements. Accordingly, the lifting system may comprise one or more curved or hinged support elements.

Alternatively, the mattress may be adjustable between an unbent configuration and a bent configuration or between two different bent configurations by moving a first inserted support element relative to a second inserted support element. The first inserted support element may be moved vertically or both horizontally and vertically relative to the second inserted support element e.g. maintained parallel with, but translated (vertically, horizontally, or both vertically and horizontally) relative to the second inserted support element.

In some embodiments, the bent configuration comprises multiple bends defined by the relative movement of multiple inserted support elements. In some embodiments, the bent configuration comprises a seated or reclined configuration. The mattress in the seated configuration may provide a substantially horizontal mattress portion between two angled end mattress portions. The two angled end mattress portions may be angled, for example, between 45° and 90° to the substantially horizontal mattress portion.

In some embodiments, the lifting system further comprises an external support to which the one or more of the support elements may be attached.

In some embodiments, the external support comprises a frame. The frame may be used to connect two or more support elements. In this regard, the frame may be used to retain the two or more support elements in a set position. The frame may also be used to lift the mattress. Accordingly, in some embodiments, the frame comprises handles for lifting the mattress.

These embodiments may be particularly useful for sporting injuries, whereby an injured player may be placed on the deflated mattress. The mattress is then inflated and the support elements inserted into the mattress. The support elements are attached to the frame and the injured player may be carried off the ground.

In some embodiments, the frame includes wheels or is connectable to a second frame comprising wheels, such that the frame may simply be pushed or pulled. For example, in some embodiments, the frame may comprise a gurney or the frame may be connectable to a gurney.

In some embodiments, the frame is adjustable such that the support elements may be attached to the frame when the mattress is in a bent configuration and when the mattress is in an unbent configuration. The frame may therefore be used for mattresses in both configurations. In some embodiments, the frame is adjustable while the support elements are attached to the frame. For example, the support elements may be attached to the frame when the mattress is in an unbent configuration and then the frame may be adjusted to move the support elements, thereby moving the mattress into a bent configuration. In this regard, the frame may comprise hinges including, for example, lockable hinges. Adjusting the configuration of the mattress by adjusting the frame may be useful when it is desired to move a person on the mattress from a reclined position to a seated position, or alternatively, to raise the persons legs.

The frame may be adjustable manually or via motorisation. In this regard, in some embodiments, the frame may house or be attachable to one or more motors and/or power sources.

In some embodiments, the external support comprises a barrier to reduce the likelihood of the weight falling off the inflated mattress. For example, the external support may comprise a rail that is higher than the mattress and which runs substantially along a boundary of the mattress.

In some embodiments, the lifting system further comprises a lifting device for lifting the inflated mattress, the lifting device comprising one or more attachment points for attaching one or more support elements (as cantilevers, or attached at both ends), and relevant hoisting machinery.

The attachment points for attaching one or more support elements to the lifting device may comprise any known attachment means. For example, the support elements may be attached to the attachment points by a threaded engagement, clamping engagement, a forked or wedge slide connection, a sleeved or spigoted connection, a male/female journal and locking screws arrangement, etc.

The hoisting machinery may include any suitable mechanism for hoisting a weight. For example, the hoisting machinery may comprise a hydraulic hoist, a pulley hoist, a chain hoist, a pneumatic hoist, a mechanical hoist, etc. The hoisting machinery may be manually operated, or power operated. Accordingly, in some embodiments, the lifting device is an automated lifting device.

In some embodiments, the hoisting machinery is able to translationally move one or more of the attached support elements relative to each other in a vertical direction, a horizontal direction or a horizontal and vertical direction.

In some embodiments, the hoisting machinery comprises independent hoisting elements, whereby each hoisting element is capable of independently moving one or more attached support elements. In this regard, the lifting device may be used to adjust the mattress between an unbent and a bent configuration or between two different bent configurations. The independent hoisting elements of the lifting device can also allow the lifting system to be used to lift a patient from a bed which is already in a bent configuration.

The lifting system comprising the lifting device may be used, for example, in hospitals and nursing homes, whereby patients are often required to be transferred between their bed and a gurney or another bed. In these embodiments, the lifting device may also comprise cantilevered support legs which are able to extend beneath the patient's bed to support the lifting device as the mattress is lifted with the patient thereon. The lifting system may also be used to adjust the position of a patient (e.g. between a reclined position and a seated position or to raise the patient's legs). This can be important for patients that are unable to move themselves easily between these positions and can offer health benefits (e.g. the change in position may be used to relieve pain or swelling, offset acid reflux, offset heartburn, improve digestion, improve breathing, relieve the heart muscle or stomach muscles, provide passive stretching, etc.).

In some embodiments, the mattress and/or lifting device may be incorporated into the design of a bed or chair.

In some embodiments, the hoisting machinery further comprises an air compressor or a compressed air storage cylinder for inflating an inflatable mattress.

In embodiments in which the lifting system may be used to lift a heavy object (e.g. a vehicle), the lifting system may comprise industrial hoisting machinery (e.g. a crane, a forklift, etc.).

A further aspect of the invention provides a method for lifting a subject or an object, the method comprising: inflating the deflated mattress as described above on which the subject or an object is resting; inserting one or more support elements into the one or more channels of the inflated mattress; and lifting the inflated mattress; wherein the one or more support elements reinforce the inflated mattress when the mattress is lifted.

In some embodiments, lifting the inflated mattress comprises lifting the mattress by the one or more support elements. Alternatively, the mattress may be lifted by handles provided by or attached to the mattress.

In some embodiments, the method further comprises placing the subject or an object on the deflated mattress before inflation thereof.

In embodiments comprising a mattress that is capable of being rolled when deflated, placing the subject on the deflated mattress may comprise:

i. placing the deflated mattress next to the subject, whereby the deflated mattress is partially or fully rolled up and the subject is on their side;

ii. unrolling part of the deflated mattress if the deflated mattress is fully rolled up;

iii. rolling the subject onto the unrolled part of the deflated mattress;

iv. unrolling the remaining part of the deflated mattress.

Placing the subject on the mattress may also comprise the above steps but where the mattress is folded instead of rolled.

As the mattress itself does not require rigid support components, the subject should experience minimal discomfort and injury as the subject is rolled onto the deflated mattress as described above.

This method may be particularly useful when the subject is injured or unable to place themselves on the mattress.

In some embodiments, the method comprises adjusting the mattress between an unbent configuration and a bent configuration or between two different bent configurations via the support elements. Methods for adjusting the mattress between an unbent configuration and a bent configuration or between two different bent configurations via the support elements are as described previously herein.

In some embodiments, lifting and/or adjusting the mattress may be performed by operating the lifting system as described above.

The method may be used for lifting an animal or a human. Accordingly, in some embodiments, the subject is an animal or a human.

In other embodiments, the method may be used for lifting an object. As described previously herein, the object may be any of a number of objects including, for example, a vehicle, goods, building material, etc.

The present invention is further described by the following non-limiting examples:

BRIEF DESCRIPTION OF THE FIGURES

Specific embodiments of the invention will now be described by way of example only with reference to the accompanying figures, in which:

FIGS. 5A to 5C show the mattress in an elevated position and in a flat configuration; FIG. 5D shows the mattress in a raised back configuration; FIG. 5E shows the mattress in a raised back and lowered leg configuration, FIG. 5F shows the large wheels reoriented, and 5G shows the mattress in a lowered position.

DETAILED DESCRIPTION OF THE PREFERRED EMBODIMENTS

Example 1

Inflatable Mattress with Single Channel and Lifting System

Figure 1A:
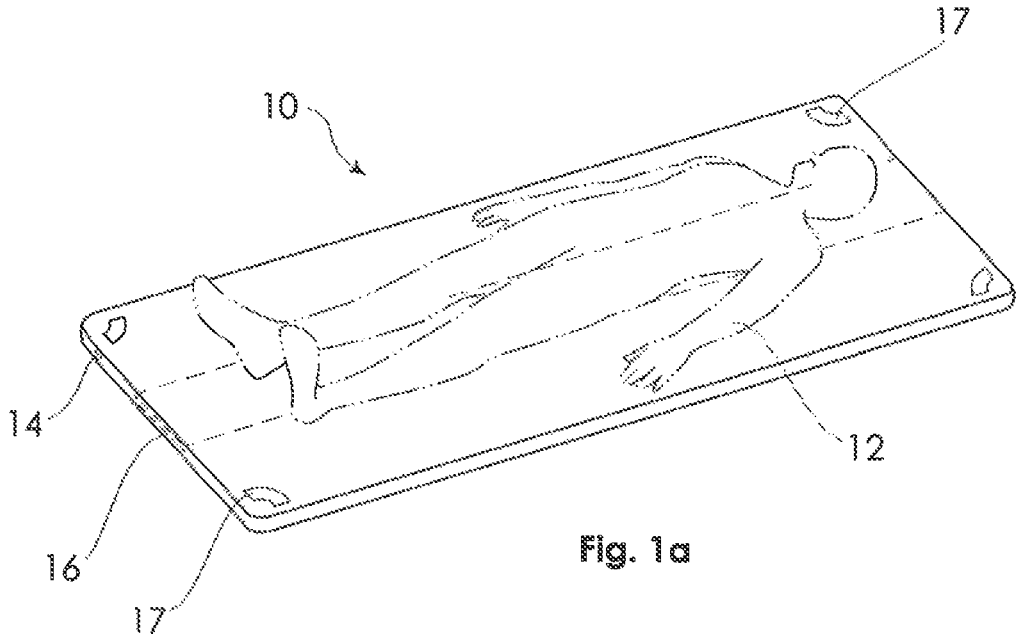
FIG. 1A shows a perspective view of an inflatable mattress in accordance with an embodiment of the present invention in which the mattress is in a deflated state.
Figure 1B:
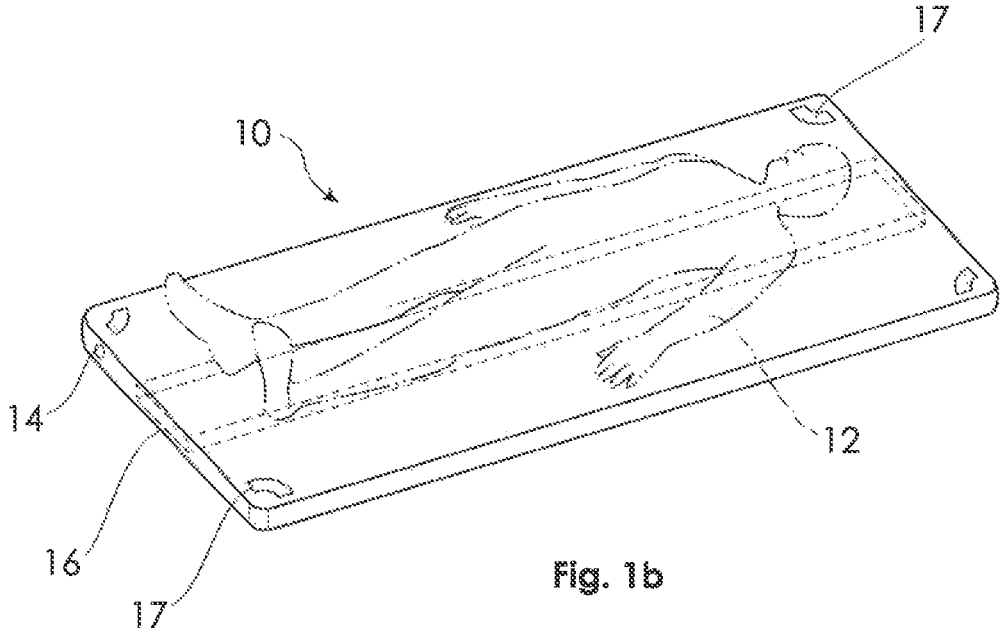
FIG. 1B shows a perspective view of the inflatable mattress of FIG. 1A in an inflated state.

FIGS. 1A and 1B show a platform in the form of an inflatable mattress 10 in a deflated state and an inflated state, respectively. Subject 12 is shown on mattress 10. The inflatable mattress comprises air inlet/air outlet 14 and longitudinally aligned channel 16. Channel 16 runs the length of mattress 10, although it is generally obscured when mattress 10 is in the deflated state.

Figure 1C:
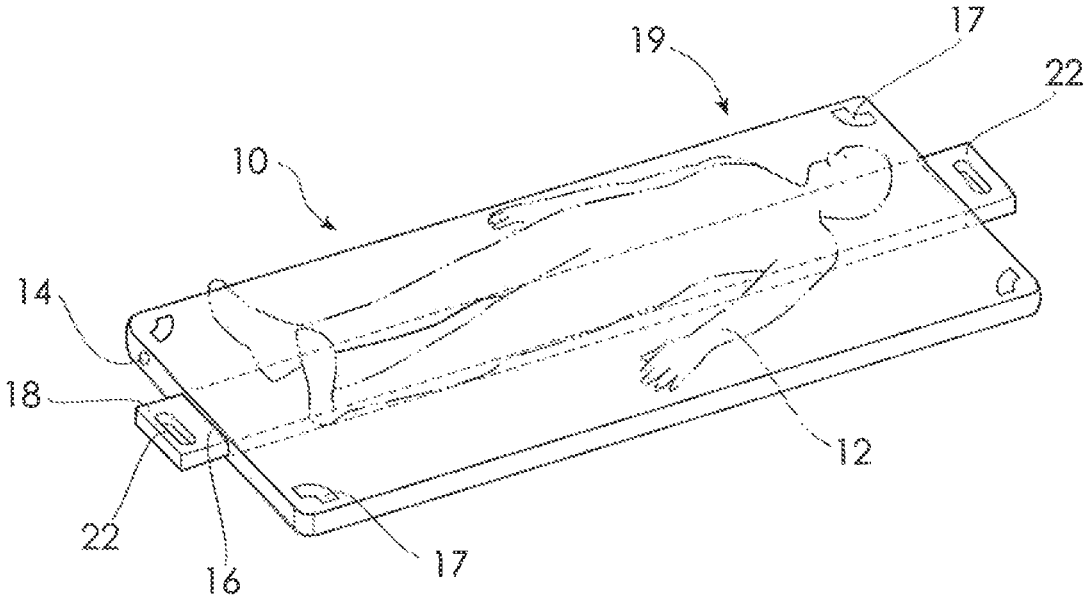
FIG. 1C shows a perspective view of a lifting system in accordance with an embodiment of the present invention, the lifting system including the inflatable mattress of FIG. 1A and FIG. 1B.

When mattress 10 is inflated by pumping air through air inlet/outlet 14, channel 16 is exposed. As shown in FIG. 1C, longitudinally disposed support element 18 may be inserted into channel 16. While support element 18 may be inserted into channel 16 when mattress 10 is deflated, inflation of mattress 10 assists the insertion, especially when mattress 10 bears a weight, such as that provided by subject 12. The combination of mattress 10 and support element 18 provides lifting system 19 in accordance with an embodiment of the present invention.

Support element 18 comprises support element handles 22 at each end to assist in the lifting of the mattress with the subject thereon. Alternatively, the mattress may be lifted with optional mattress handles 17.

Figure 10:
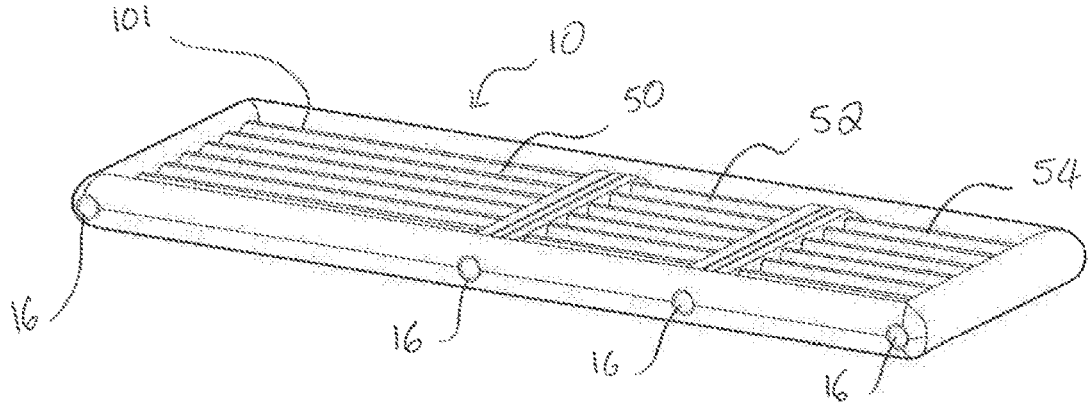
FIG. 10 is a perspective view of a platform for the lifting system, the platform being in the form of an inflatable mattress with four attachment structures in the form of lateral channels spaced along the length of the mattress.

In the embodiment shown in FIG. 10, subject 12 may be lifted on the mattress 10 in the inflated or deflated state, as support element 18 can adequately support the subject when mattress 12 is deflated. This embodiment is therefore useful in situations where it is desirable to move or lift subject 12 on a rigid support. However, it is envisaged that in most cases, the subject will be lifted on mattress 10 in the inflated state as the inflated state can provide more support and comfort to subject 12.

Example 2

Inflatable Mattress with Multiple Channels and Lifting System

Figure 2A:
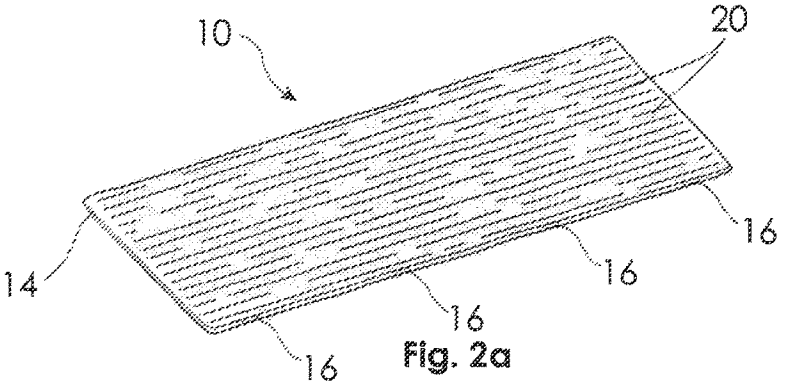
FIG. 2A shows a perspective view of an inflatable mattress and a lifting system in accordance with another embodiment of the present invention. The inflatable mattress is shown in a deflated state.

FIG. 2A shows inflatable mattress 10 in accordance with another embodiment of the invention. Inflatable mattress 10 is shown in a deflated state and includes a series of longitudinal compartments 20 in fluid communication with each other. Compartments 20 are inflated by pumping air through air inlet/outlet 14. Entries to laterally aligned channels 16 are provided in the side of mattress 10, although they are generally obscured when mattress 10 is in the deflated state. Channels 16 run the width of mattress 10.

Figure 2B:
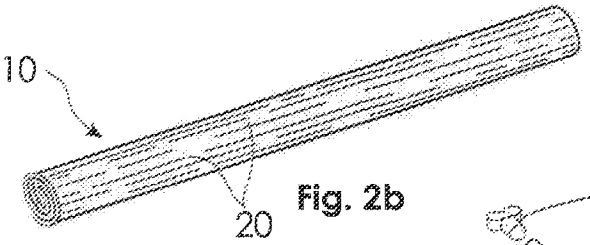
FIG. 2B shows a perspective view of the inflatable mattress of FIG. 2A in a rolled configuration.

As shown in FIG. 2B, mattress 10 may be rolled when in the deflated state. Mattress 10 may also be folded, although is not illustrated. Rolling or folding mattress 10 allows for compact storage of mattress 10 and can also assist in the transfer of a subject onto mattress 10 as previously described herein.

Figure 2C:
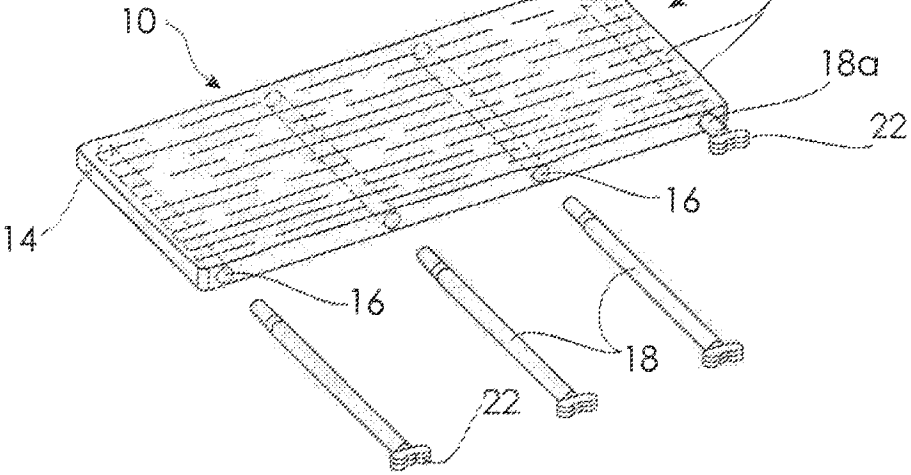
FIG. 2C shows a perspective view of the inflatable mattress of FIG. 2A in an inflated state and in use with a lifting system in accordance with an embodiment of the present invention.

FIG. 2C shows mattress 10 of FIG. 2A and FIG. 2B in an inflated state and in use with laterally disposed support elements 18. In combination, mattress 10 and support elements 18 provide lifting system 19 in accordance with an embodiment of the present invention. Once mattress 10 is inflated by pumping air into compartments 20 through air inlet/outlet 14, the entries to channels 16 are exposed. Support elements 18 may be inserted into channels 16. Support element 18*a* shows a support element that has been inserted into channel 16.

Support elements 18 are provided with handles 22. As illustrated, handle 22 has a greater diameter than channel 16. Therefore for each support element 18, at least one handle is removable, such that support element 18 may be inserted from one side into channel 16. Handle 22 may then be attached to the inserted support element 18 (e.g. by threaded engagement, snap-locking, etc.), thereby permitting support element 18 to be gripped at each end. Handles 22 can also prevent support element 18 from falling out of channel 16.

Figure 2D:
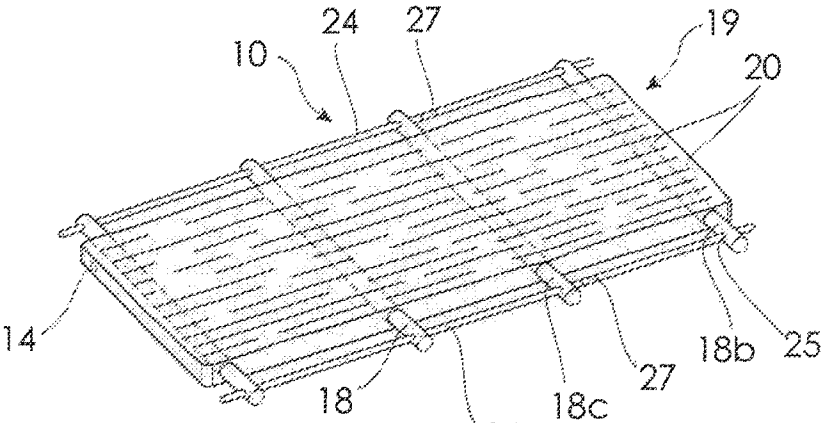
FIG. 2D shows a perspective view of the inflatable mattress of FIG. 2A in an inflated state an in use with a lifting system in accordance with another embodiment of the present invention.

FIG. 2D shows mattress 10 of FIGS. 2A to 2C in an inflated state and in use with support elements 18 that are connected at each end to frames 24. Mattress 10 is inflated and support elements are inserted as described above in relation to FIG. 2C. In this instance, support elements 18 do not include handles, but rather connectors 25 for connecting to frames 24. Connectors 25 are illustrated as holes in support elements 18 through which each frame 24 may be inserted.

Alternatively, the holes may be provided in frames 24 with support elements 18 inserted therein. Other connectors 25 may be used that allow support elements 18 to be connected to frames 24 including, for example, snap locks, clamps, spigoted, semi-circular or purpose made connectors, connectors using locking or spring loaded pins to locate and maintain the connection, etc. Frames 24 may be retained in place by using stops (not illustrated) to prevent support elements 18 from disconnecting with frames 24.

As frames 24 connects multiple support elements 18, mattress 10 may be lifted by frames 24. Support elements 18 reinforce mattress 10 as it is lifted, particularly when lifted with a weight thereon. Compartments 20 provide longitudinal strength to mattress 10, particularly between channels 16. Lifting system 19 is particularly suitable for use as a stretcher.

Frames 24 may comprise one or more lockable hinges 27 for moving mattress

Figure 2E:
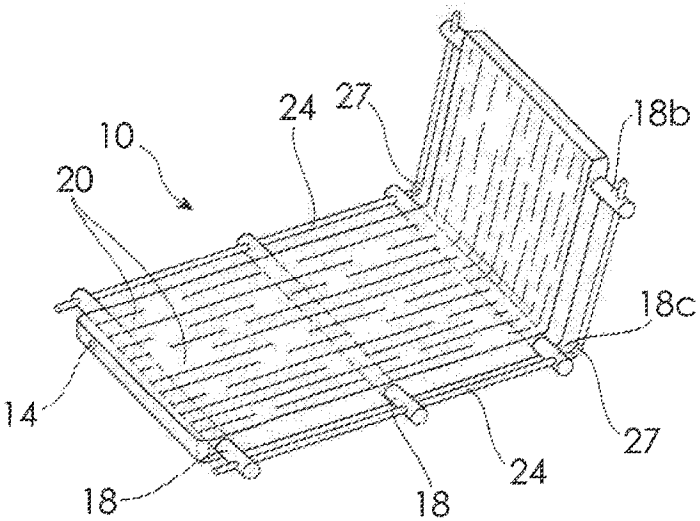
FIG. 2E shows a perspective view of the inflatable mattress and lifting system of FIG. 2D with the mattress in a bent configuration.

10 between an unbent configuration as shown in FIG. 2D and a bent configuration as shown in FIG. 2E. Lockable hinge 27 may be provided anywhere along frame 24, although it is preferable that lockable hinge 27 is provided in line with one of the channels, thereby allowing mattress 10 to be bent around one of the channels (or support element 18 inserted therein). Channels 16 provide particularly suitable bending points as channel 16 has less air volume in mattress 10 directly above or below channel 16. Therefore the amount of air displacement required for mattress 10 to bend around channel 16 is reduced, and the bend is therefore more easily facilitated. Support element 18 in channel 16 also provides support along the bend when mattress 10 is lifted with a weight thereon.

FIG. 2E shows mattress 10 of FIG. 2D with the inflated mattress 10 in a bent configuration. Mattress 10 is moved between the unbent configuration of FIG. 2D and the bent configuration of FIG. 2E by unlocking lockable hinges 27 and translationally moving, for example, support element 18*b* relative to support element 18*c* (i.e. about the longitudinal axis of support element 18*c*). Lockable hinges 27 are then locked, thereby retaining the mattress in the bent configuration. Mattress 10 may then be lifted in the bent configuration via frames 24.

As will be appreciated, frames 24 may be provided with a plurality of lockable hinges 27, or the like, to allow mattress 10 to have different bent configurations (e.g. a seated configuration or a configuration to raise a subjects legs).

Example 3

Inflatable Mattress and Lifting System Suitable for Hospitals

Figure 3A:
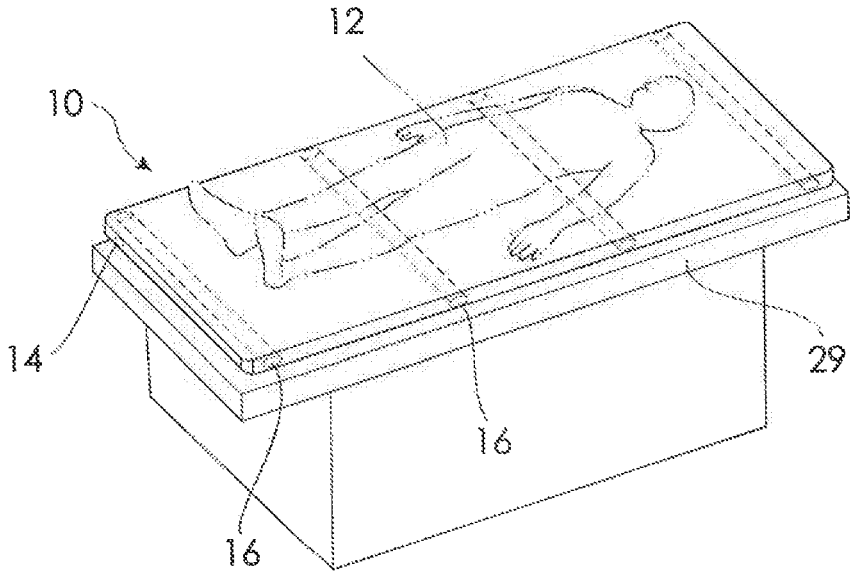
FIG. 3A shows a perspective view of an inflatable mattress in accordance with an embodiment of the present invention on a hospital bed. The inflatable mattress is shown in a deflated state with a subject thereon.

FIG. 3A shows mattress 10 of FIGS. 2A to 2D in a deflated state on hospital bed 29. Subject 12 has been placed on mattress 10 as described above (i.e. subject 12 is rolled on their side, mattress 10 in a semi rolled configuration is placed next to subject 12, subject 12 is rolled onto their other side and onto the unrolled part of mattress 10, the remaining rolled part of mattress 10 is unrolled and subject 12 is rolled back to their original position).

Figure 3B:
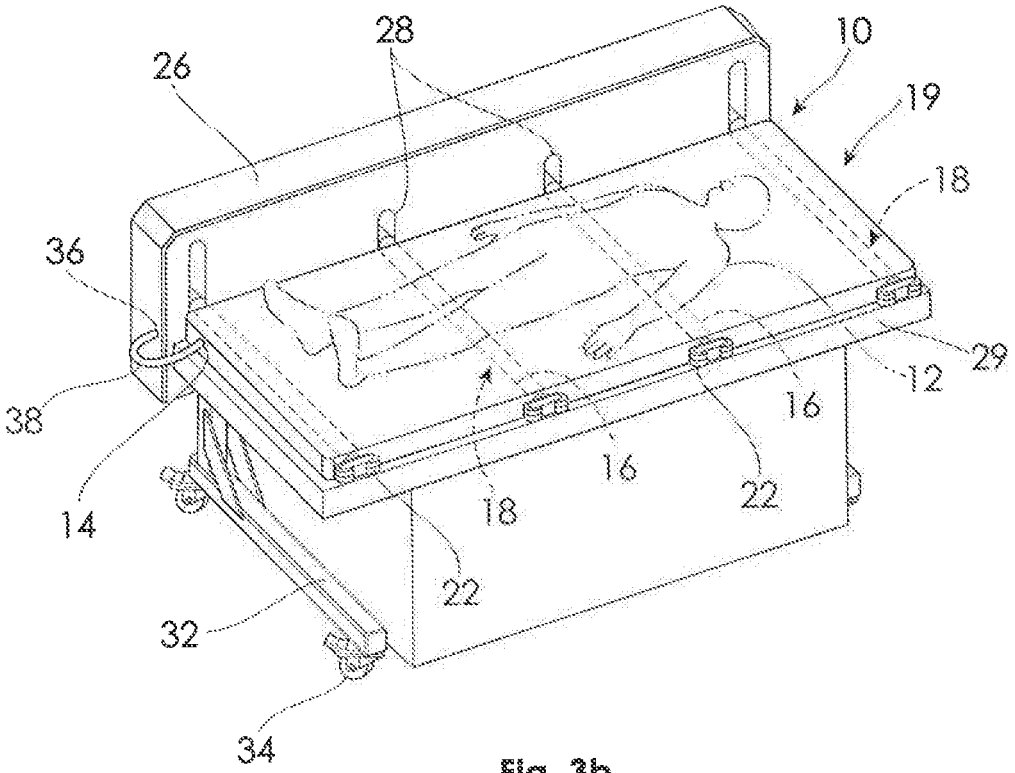
FIG. 3B shows a perspective view of the inflatable mattress of FIG. 3A in use with a lifting system according to an embodiment of the present invention.

Mattress 10 is inflated by pumping air from air compressor 36 through hose 38 and into mattress 10 through air inlet/outlet 14, as shown in FIG. 3B, subsequently raising subject 12 and exposing the entries of channels 16. Air compressor 36 is provided on lifting device 26 of lifting system 19.

Once mattress 10 is inflated, support elements 18 are inserted into channels 16. Support elements 18 are then attached to attachment points 28 on lifting device 26. Lifting device 26 includes cantilevered support legs 32 with wheels 34 attached thereto. Legs 32 allow lifting device 26 to be positioned close to hospital bed 29 and also provide the balance required for lifting system 26 to lift mattress 10 with subject 12 thereon. Once mattress 10 has been lifted from hospital bed 29, the lifting device may be wheeled to another location (e.g. a surgical theatre, another bed, etc.). A support rail (not illustrated) may be attached to support elements 18 at the opposite end as lifting device 26 to ensure that subject 12 is retained on mattress 10.

Once mattress 10 has been placed, for example, on another bed using lifting system 26, support elements 18 are removed and mattress 10 is deflated by opening air inlet/outlet 14. Mattress 10 may be removed from under subject 12 in the deflated state by reversing the method used to place subject 12 on mattress 10.

Internal hoisting machinery 30 used in the lifting system 26 is known in the art. Lifting system 26 can allow for all support elements 18 attached thereto to be lifted at the same time and over the same distance (i.e. the entire mattress 10 may be lifted vertically) or lifting system 26 can allow for independent parallel translational movement of one or more support elements 18.

Figure 3C:
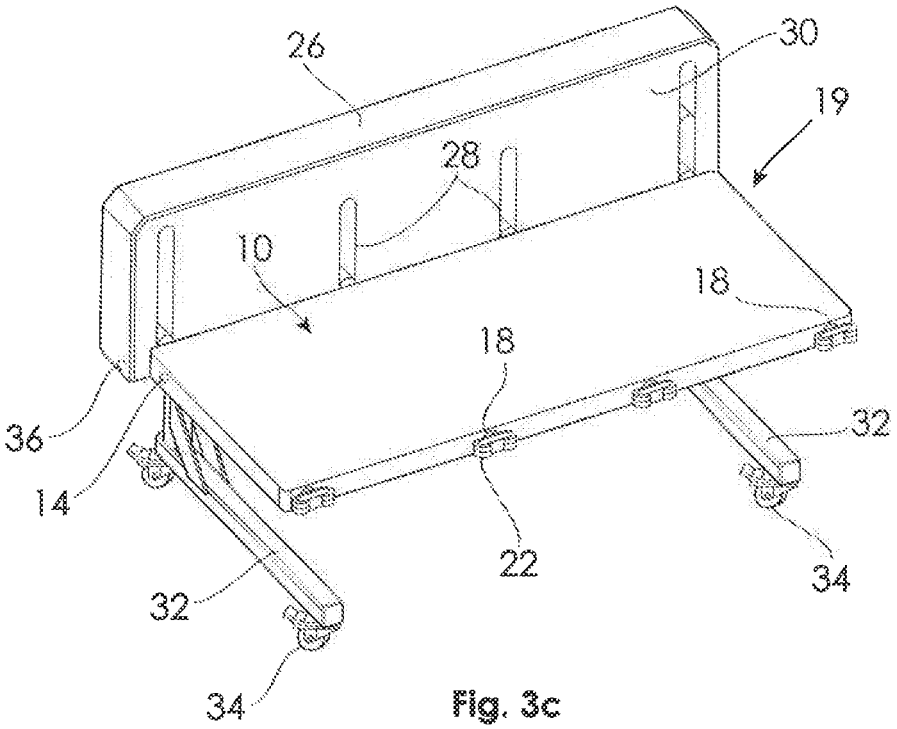
FIG. 3C shows a perspective view of the inflatable mattress and a lifting system of FIG. 3B with the mattress in an unbent configuration. The hospital bed and subject are not shown for ease of illustration.
Figure 3D:
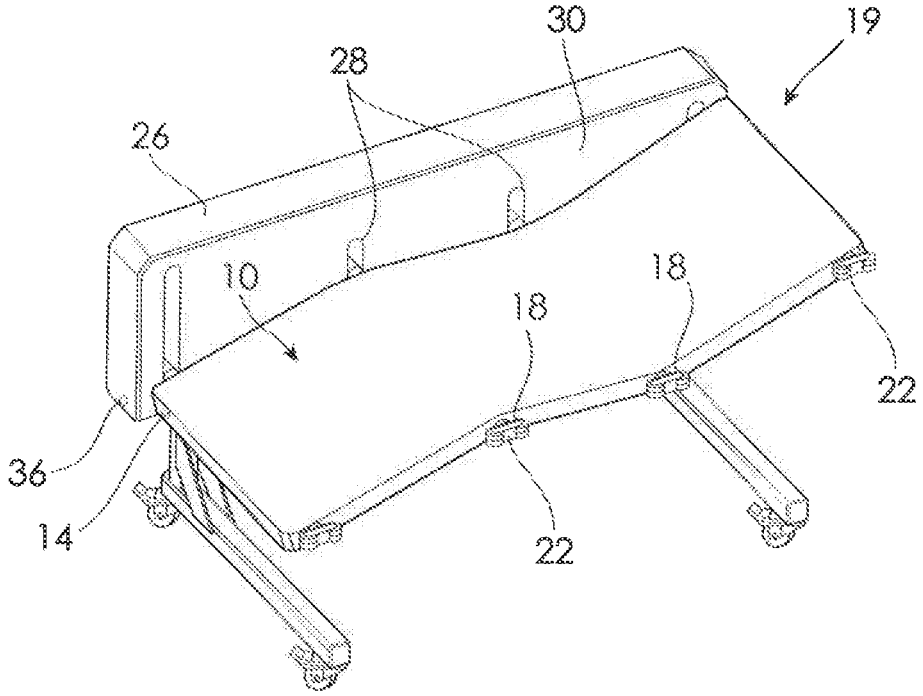
FIG. 3D shows a perspective view of the inflatable mattress and lifting system of FIG. 3C with the mattress shown in a bent configuration.

FIGS. 3C and 3D are shown without hospital bed 29 and subject 12 for ease of illustration. FIG. 3C shows mattress 10 in an unbent configuration and attached to lifting device 26 via support elements 18. It will be appreciated that the support elements 18 act as cantilevers. By operating lifting device 26, individual support elements 18 may be lifted to move mattress 10 from the unbent configuration to a bent configuration or between two different bent configurations, as illustrated in FIG. 3D. Accordingly, lifting device 26 may be used to move subject 12 from a reclined position to a seated position. Providing adjustable mattress configurations can aid in the comfort of subject 12 as well as offering health benefits e.g. it may be used to relieve pain or swelling, offset acid reflux, offset heartburn, improve digestion, improve breathing, relieve the heart muscle or stomach muscles, provide passive stretching, etc.

As lifting device 26 allows independent operation of hoisting machinery 30, lifting device 26 in conjunction with mattress 10 can also be used to lift subjects from beds that have seated or other configurations or transfer subjects to beds that have seated or other configurations.

Lifting device 26 as shown allows for vertical actuation of support elements 18 attached thereto. Other lifting devices may be used that allow vertical and horizontal actuation of support elements 18 e.g. other lifting devices may be used to parallel translationally move one or more support elements about a longitudinal axis of another support element.

While mattress 10 is illustrated with longitudinal compartments 20 and a single air inlet/outlet, it will be appreciated that different mattresses with different compartment and valve arrangements (e.g. multi-valves) may be used. For example, different compartment arrangements and/or selective inflation of different compartments may be used to support the needs of different patients. Colour-coding or other marking of the compartments and/or valves can assist users in the selective inflation of the compartments and/or in the selection of an appropriate mattress for different patients.

Example 4

Figure 4A:
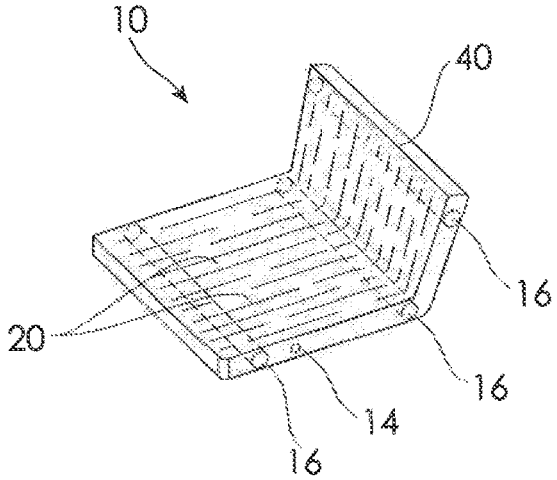
FIG. 4A shows a perspective view an inflatable mattress in accordance with another embodiment of the present invention. The inflatable mattress is shown in an inflated state.
Figure 4B:
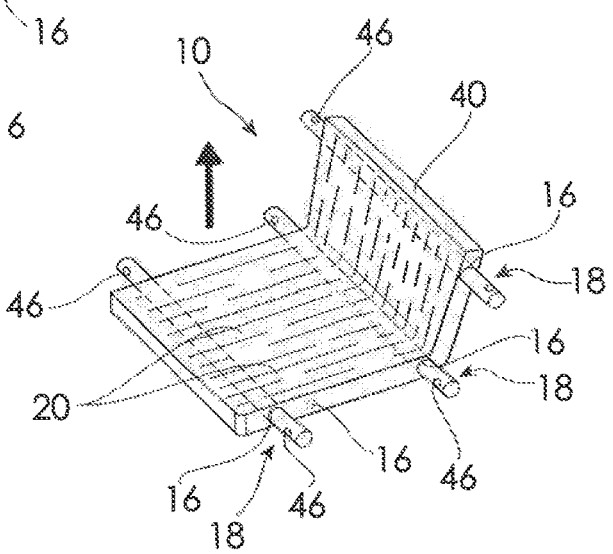
FIG. 4B shows a perspective view the inflatable mattress of FIG. 4A in use with a lifting system in accordance with an embodiment of the present invention.

Inflatable Mattress and Lifting System Suitable for Transferring Subjects to and from Wheelchairs FIG. 4A shows inflatable mattress 10 in an inflated state and in accordance with another embodiment of the present invention. Mattress 10 is particularly suitable for lifting subjects from seats or wheelchairs. Mattress 10 may include back portion 40 or may be substantially flat. Back portion 40 provides additional support when a subject is lifted on to mattress 10. Mattress 10 includes compartments 20 to provide support between channels 16.

As described above, it is envisaged that the subject will generally be placed on mattress 10 in a deflated state (not illustrated). Mattress 10 is inflated via air inlet/outlet 14, thereby exposing the entries to channels 16. Support elements 18 are then inserted into channels 16. Support elements 18 include attachments 46 that may be attached to a suitable lifting device (not illustrated). Suitable lifting devices are disclosed in the prior art including, for example, U.S. Pat. Nos. 3,694,829, 6,637,610 and 6,938,285, and WO/2006/032108. Attachments 46 may comprise, for example, hooks, holes or the like that allow support elements 18 to be attached to the lifting device. Alternatively, support elements 18 may be provided with handles (not illustrated) that enable lifting without a lifting device.

Figure 4C:
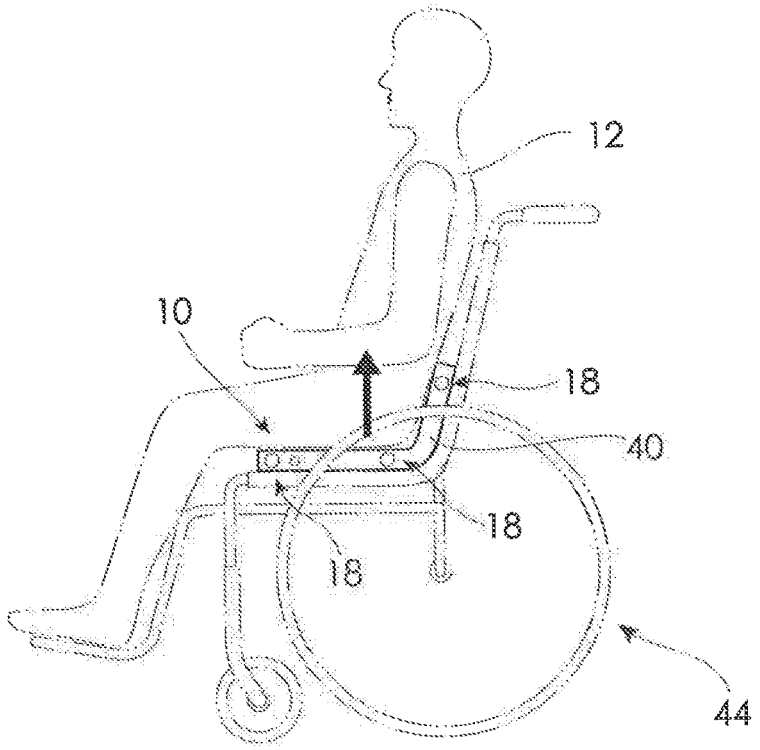
FIG. 4C shows a cross-sectional view of the inflatable mattress and lifting system of FIG. 4B used to lift a subject from a wheelchair.

FIG. 4C shows mattress 10 being used for a subject 10 in a wheelchair 44. Subject 10 is sitting on mattress 10 in an inflated state and support elements 18 have been inserted into channels 16. Support elements 18 may be attached to a suitable lifting device (not illustrated) and mattress 10 lifted thereby. Back portion 40 provides rear support to subject 12 when mattress 10 is lifted.

Once subject 12 is transferred to the desired seat, support elements 18 may be detached from the lifting device and removed from mattress 10. Optionally, mattress 10 is then deflated. As mattress 10 does not require rigid support components, mattress 10 in its deflated state will not cause subject 12 significant discomfort. Accordingly, subject 10 may remain seated on the mattress 10 for a prolonged period (e.g. the duration of a plane flight). In some embodiments, mattress 10 may be incorporated into the subject's clothing (not illustrated).

Example 5

Inflatable Mattress and Multi-Function Lifting System

FIGS. 5A to 5G illustrate an alternative embodiment of a lifting system 126. The lifting system 126 includes a lower frame 102 having wheels or casters 104. A vertical support 106 extends from the lower frame 102.

The vertical support 106 connects with a support frame 124 via sleeve 128 extending from the support frame 124. The sleeve 128 can be slid along the height of the vertical support 106 and locked into a selected height position. The support frame 124 releasably carries support elements 118. As with previous embodiments, the support elements 118 are received in channels through the mattress 110 when the mattress 110 is in an inflated state. The support elements 118, in this arrangement, act as cantilevers.

The support frame 124 includes lockable hinge portions 127 which allows the support frame 124 to adopt different configurations. In effect, this allows the support elements 118 to be parallel translationally moved with respect to one another; which, in turn, causes the mattress 110 to adopt different configurations, see FIGS. 5B, 5D and 5E The lifting system 126 is shown with a pair of large wheels 144 arranged on a common axle member 146. The axle member 146 is arranged to be releasably attached to the vertical support 106 via a clamp 150. Consequently, the large wheels 144 can be selectively removed from the system 126 if, or when, they are not required. The axle member 146 can be reoriented by pivoting around the clamp 150 to change the position of the large wheels 144, see FIG. 5F. The large wheels 144 allow a subject 112 to manually maneuver the system 126, particularly when the support frame 124 is configured to adopt a sitting position, thereby acting like a wheel chair. As shown, the axle member 146 includes an additional strut support 148 for attachment to ends of support members 118.

Figure 5A:
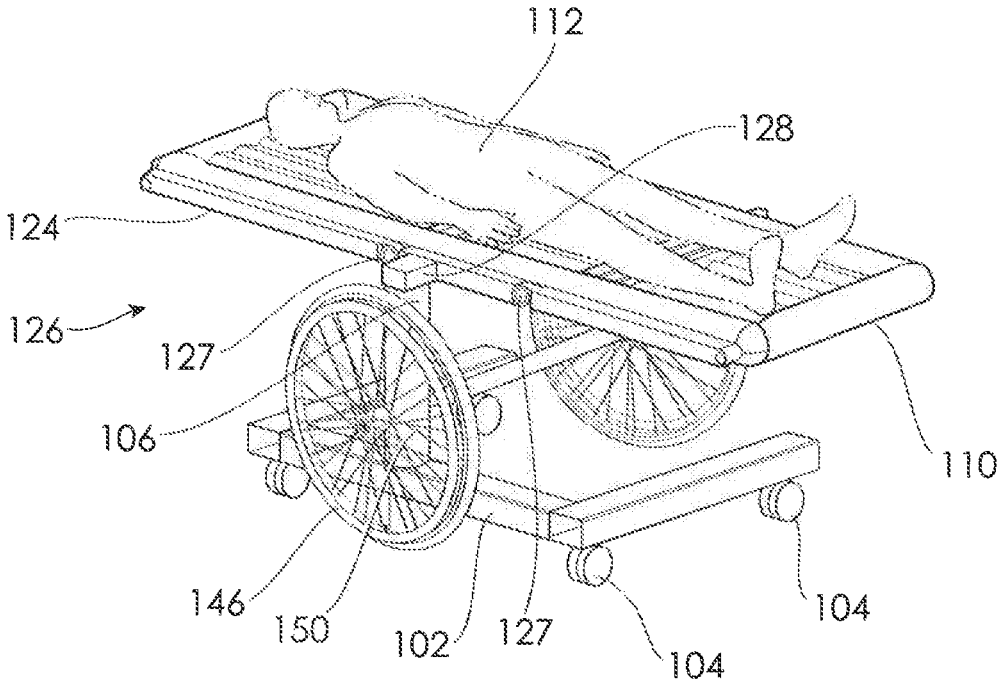
FIGS. 5A to 5G shows an inflatable mattress and lifting system in accordance with a further embodiment of the present invention in various perspectives and configurations.
Figure 5B:
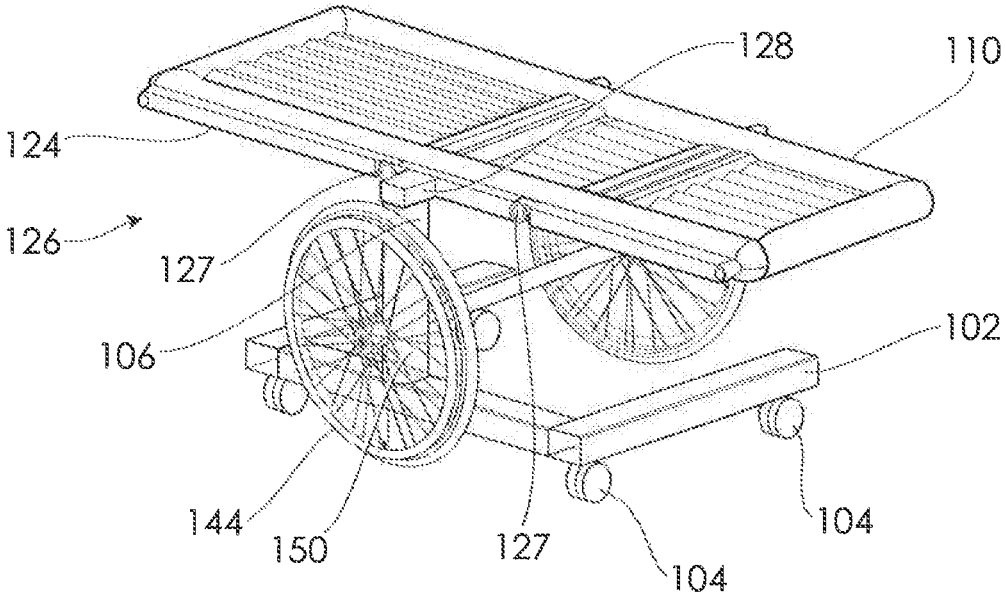
Figure 5C:
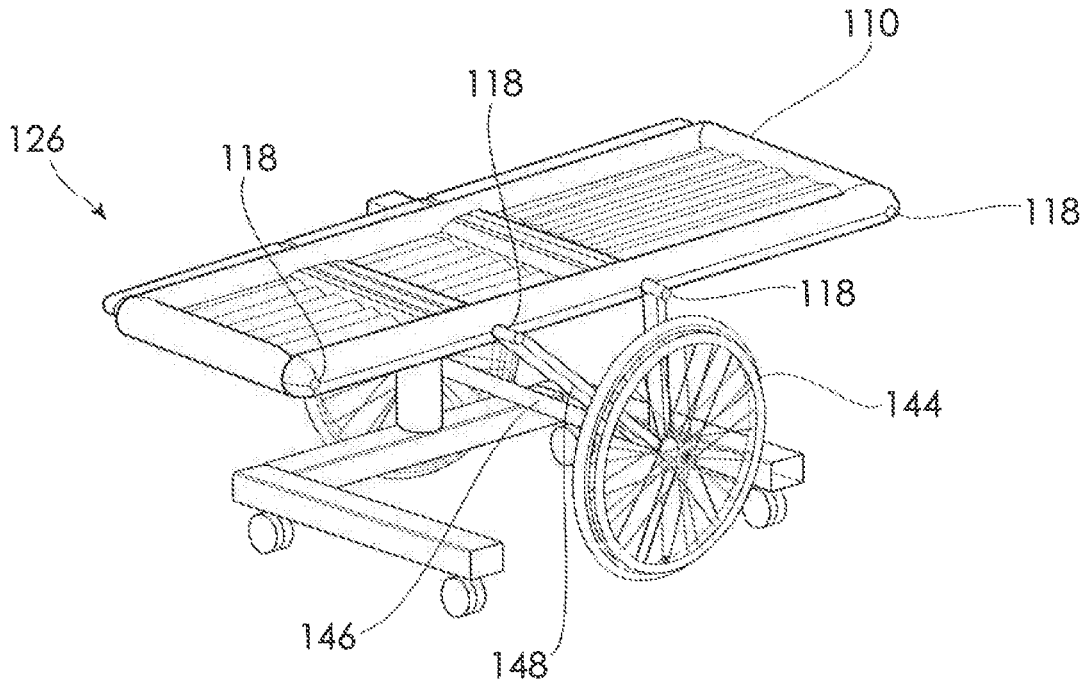
Figure 5D:
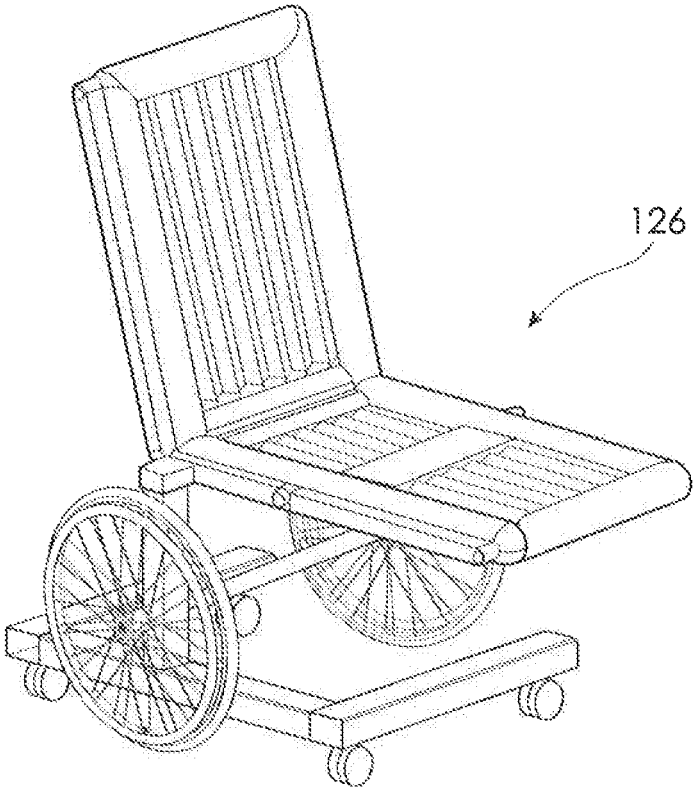
Figure 5E:
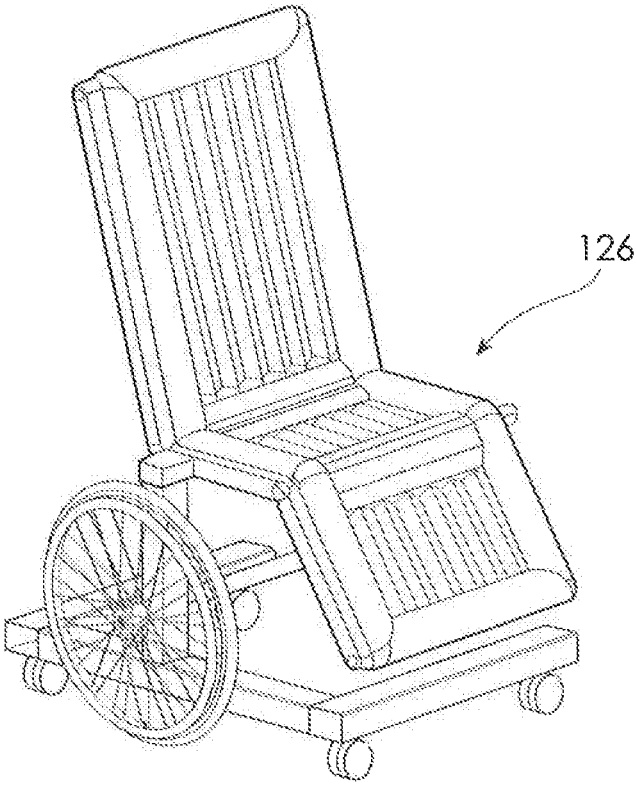
Figure 5F:
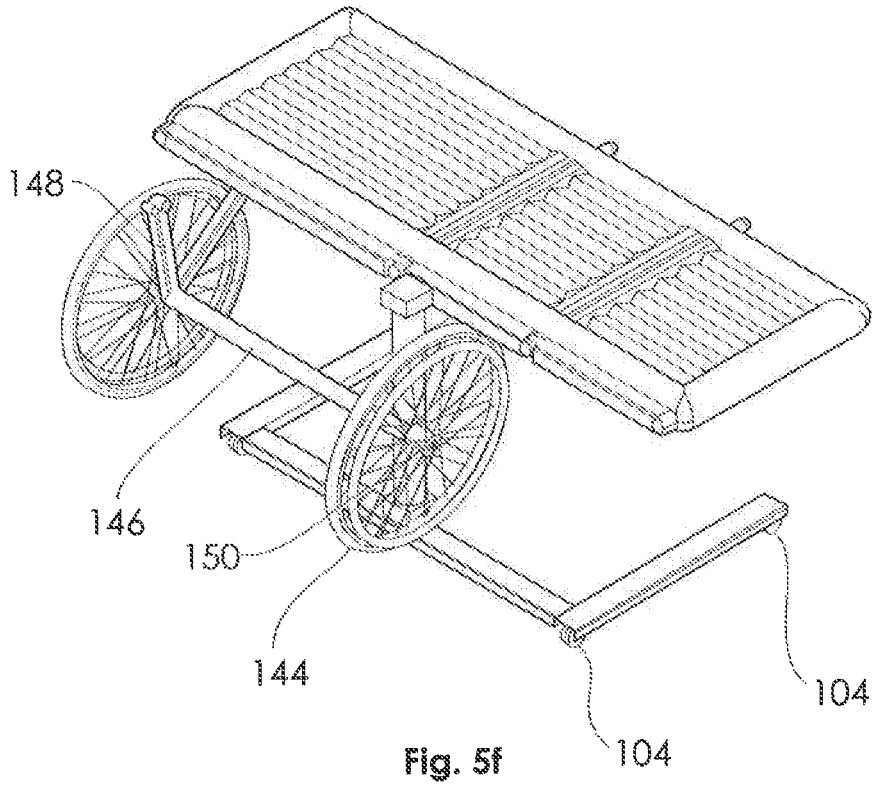
Figure 5G:
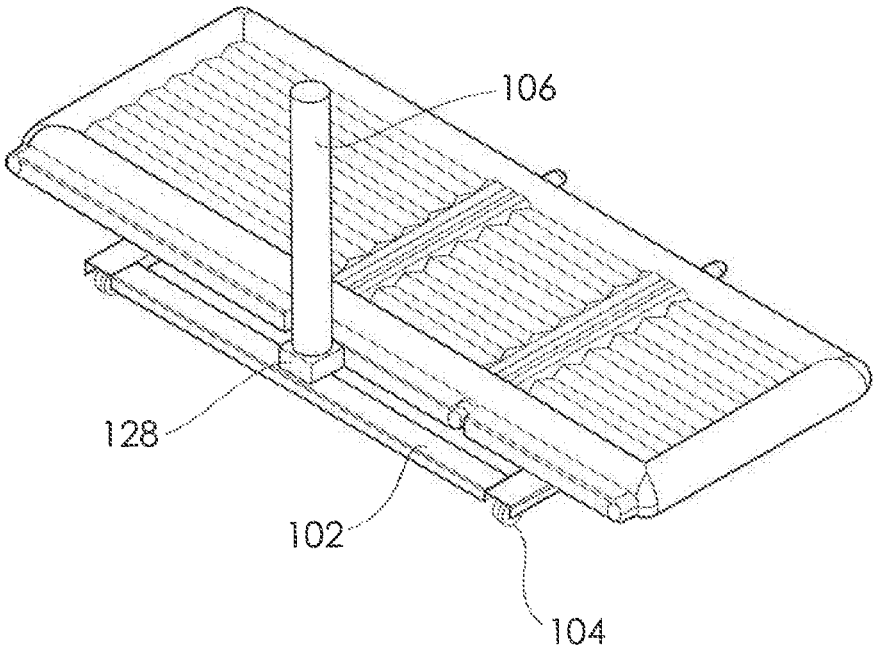

The wheels or casters 104 are adapted to be moved within recesses in the lower frame 102 (refer to FIGS. 5F and 5G). Hence, when the wheels 104 are retained within these recesses and the sleeve 128 is moved to the lowest position on vertical support 106, the mattress is positioned as close to the ground as possible (see FIG. 5G).

Figure 6:
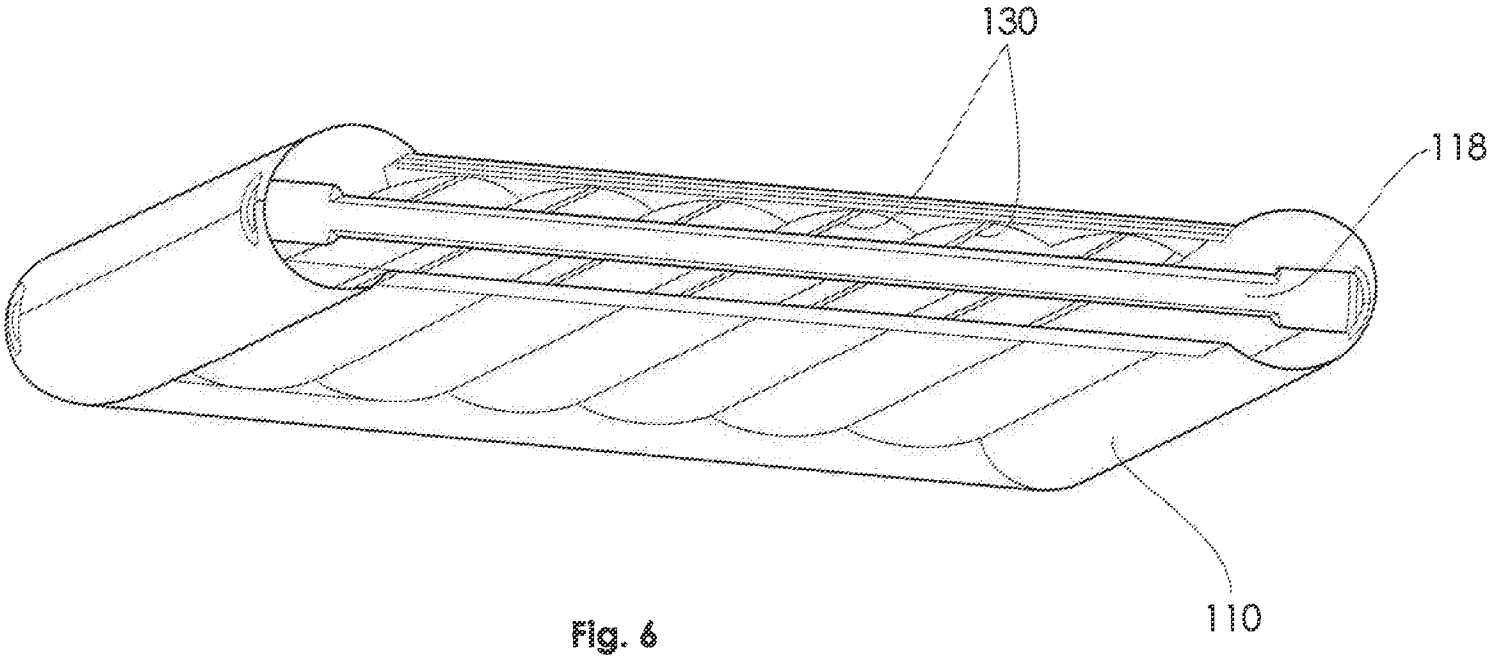
FIG. 6 is a cross-sectional view of the mattress of FIGS. 5A to 5G.

The mattress 110, illustrated in FIGS. 5A to 5G, differs from previous embodiments by the inclusion of thin stiffeners 130, shown clearly in FIG. 6. The stiffeners 130 can be made of any suitable flexible but strong material, such as carbon fibre. The stiffeners 130 can be bonded to the inside top of the mattress 110 by any suitable means, for example gluing or stitching. Alternatively, the upper fabric of the mattress could incorporate channels in which the stiffeners 130 can be inserted during manufacture. As will be appreciated, the stiffeners 130 offer additional support to a subject 112 and also a degree of rigidity to the mattress 110 when in a deflated state.

Figure 7:
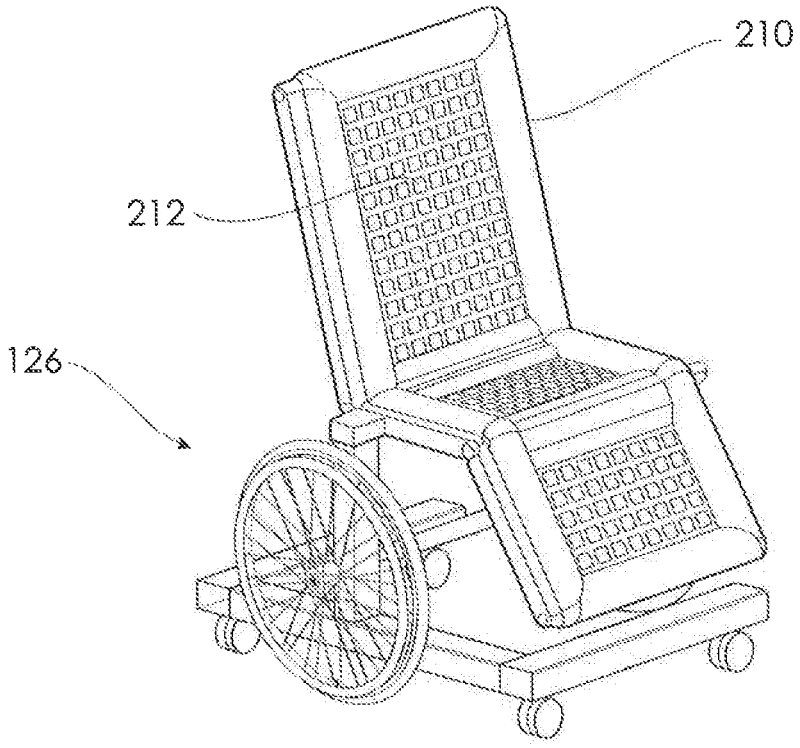
FIG. 7 shows an alternative embodiment of an inflatable mattress in association with the lifting system of FIGS. 5A to 5G.
Figure 8:
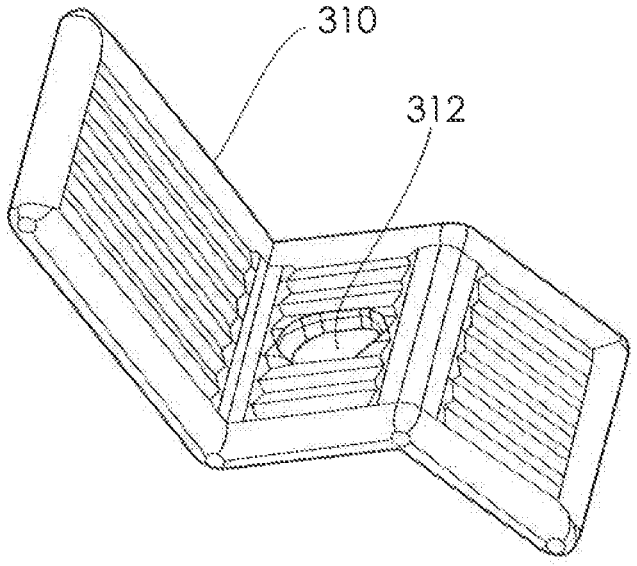
FIG. 8 shows a further alternative embodiment of an inflatable mattress.

Variations on the mattress embodiment are shown in FIGS. 7, 8, 9A and 9B. In FIG. 7, the mattress 210 includes mesh panels 212. This offers a water permeable version of the mattress which would be particularly suited for bathing purposes. FIG. 8 illustrates an embodiment of the mattress 310 having an orifice 312 suitably positioned to offer a toileting option for a subject, whereby a suitable waste catching receptacle could be arranged within or underneath the orifice 312.

Figure 9A:
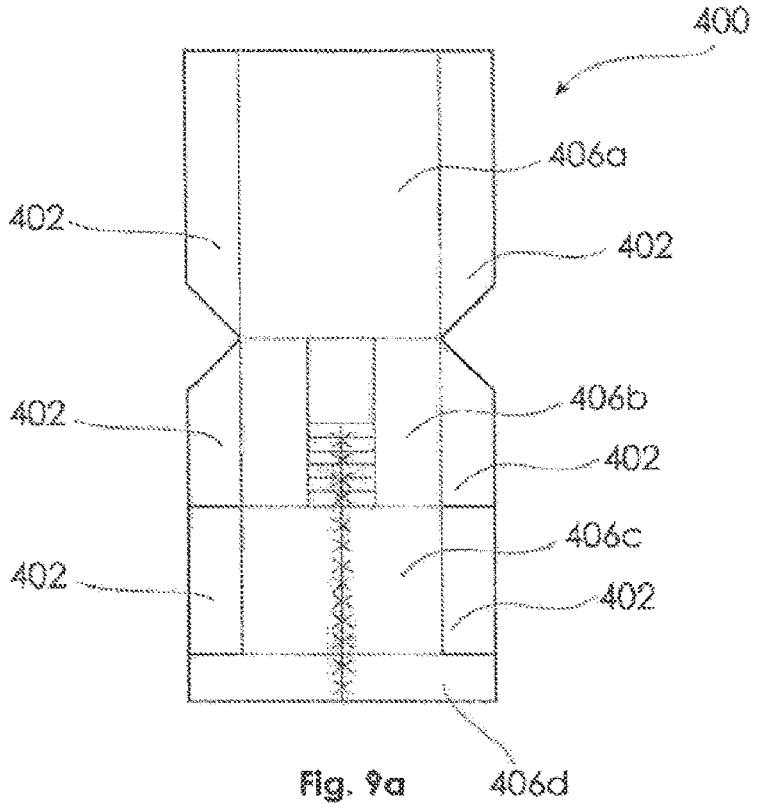
FIGS. 9A, 9B, and 9C show a further alternative embodiment of an inflatable mattress.
Figure 9B:
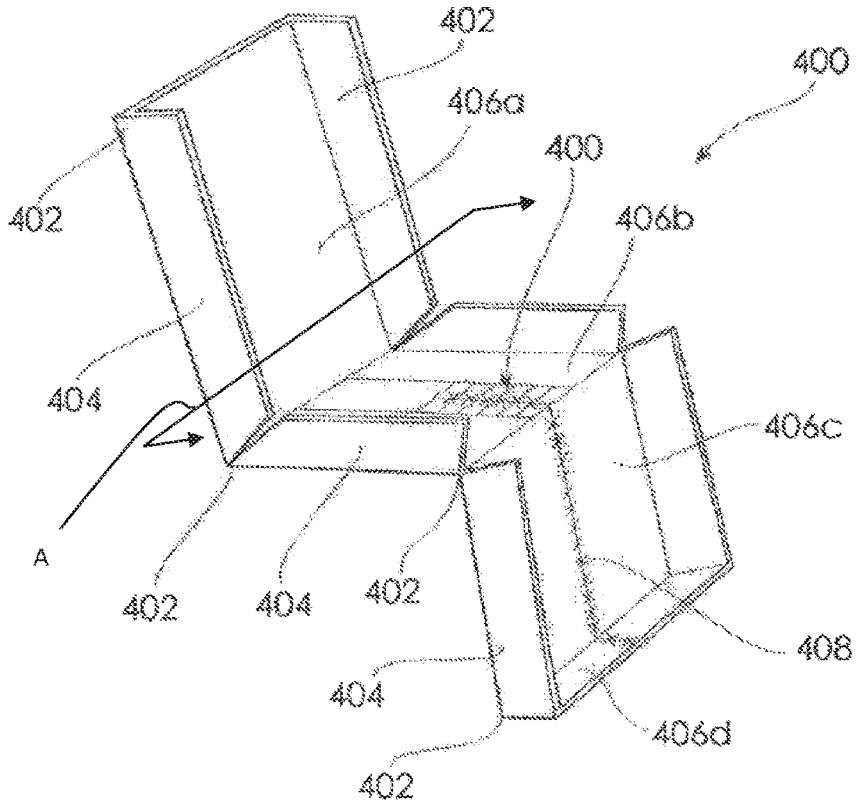

FIGS. 9A and 9B illustrate a mattress 400. The mattress 400 includes lateral supports 402 that extend laterally across the width of the mattress 400. As shown, a lateral support 402 is preferably located adjacent the upper most edge of the mattress and/or at or adjacent to each folding/bending position of the mattress 400. The lateral supports 402 are preferably located within a channel or sleeve formed within the mattress 400. The lateral supports 402 serve to define the top, middle, lower and foot panels 406*a*, 406*b*, 406*c*, 406*d* of the mattress 400.

The mattress 400 further includes side panels 404 which are inflatable. The side panels 404 are preferably arranged to be foldable with respect to adjacent respective top, middle, lower and foot panels 406*a*, 406*b*, 406*c*, 406*d*. When inflated, the side panels 404 preferably extend substantially perpendicularly to the plane of the adjacent top, middle and lower panels 406*a*, 406*b*, 406*c*, although a range of other angles are envisaged. The inflatable side panels 404 provide restraint and lateral support for the user and also provide stabilizing support for the mattress 400. In this manner, the inflated side panels 404 act as "beams" and the load of the user can be effectively supported on the "beams" of the mattress 400 during lifting.

The mattress 400 is fitted with a longitudinal joining device 408 that extends along at least a part of the middle panel 406*b*, lower panel 406*c* and foot panel 406*d*. The joining device 408 is preferably a zipper or a hook and loop type fastener connection. The inclusion of the joining device 408 is advantageous because when released the middle and lower panels 406*c* can be split to facilitate placement of a user on the mattress 400. This is particularly useful when the user is sitting in an upright position such as when on a chair.

The mattress 400 is also fitted with a toileting aperture. The aperture may be established by a panel 410 which can be folded or otherwise moved out of the way to effectively open the aperture in the middle panel 406*b*. The middle panel 406*b* provides the seat surface when the mattress 400 is folded into a seated configuration as shown in FIG. 9B. Alternatively, the panel 410 may be an inflatable panel which includes an opening that is revealed/opened when the panel 410 is deflated and closed when the panel is inflated.

The mattress 400 preferably includes foot panel 406*d*. The foot panel 406*d* establishes a surface which the user may press against to enable adjustment of their positioning on the mattress 400. The foot panel 406*d* may be inflatable and is preferably of sufficient rigidity to enable the user to press against it and thereby adjust their body position on the mattress 400.

The mattress 400 shown in FIGS. 9A and 9B may be made of a range of different materials. However, it is envisaged that at least the top, middle and lower panels 406*a*, 406*b*, 406*c* of the mattress 400 include a top layer, a bottom layer and an intermediate spacer layer made of a spacer fabric. Such an arrangement enables the top, middle and lower panels 406*a*, 406*b*, 406*c* of the mattress 400 to be inflatable.

The use of such a spacer layer negates the need to use baffles within the mattress 400 whilst allowing much higher inflation pressures to be used. This allows the mattress to be thinner than otherwise possible.

A spacer fabric is a fabric made from a complex three dimensional construction made of two or more separate fabric layers connected vertically with the pile yarns or fabric layers keeping hollow space between adjacent connecting yarns or layers. Spacer fabrics are manufactured using methods such as weaving, braiding, stitching, warp knitting and weft knitting. A preferred form of spacer fabric for use in a mattress according to an embodiment of the invention is a "drop stitch" fabric (commonly used for inflatable stand-up paddle boards).

Figure 9C:
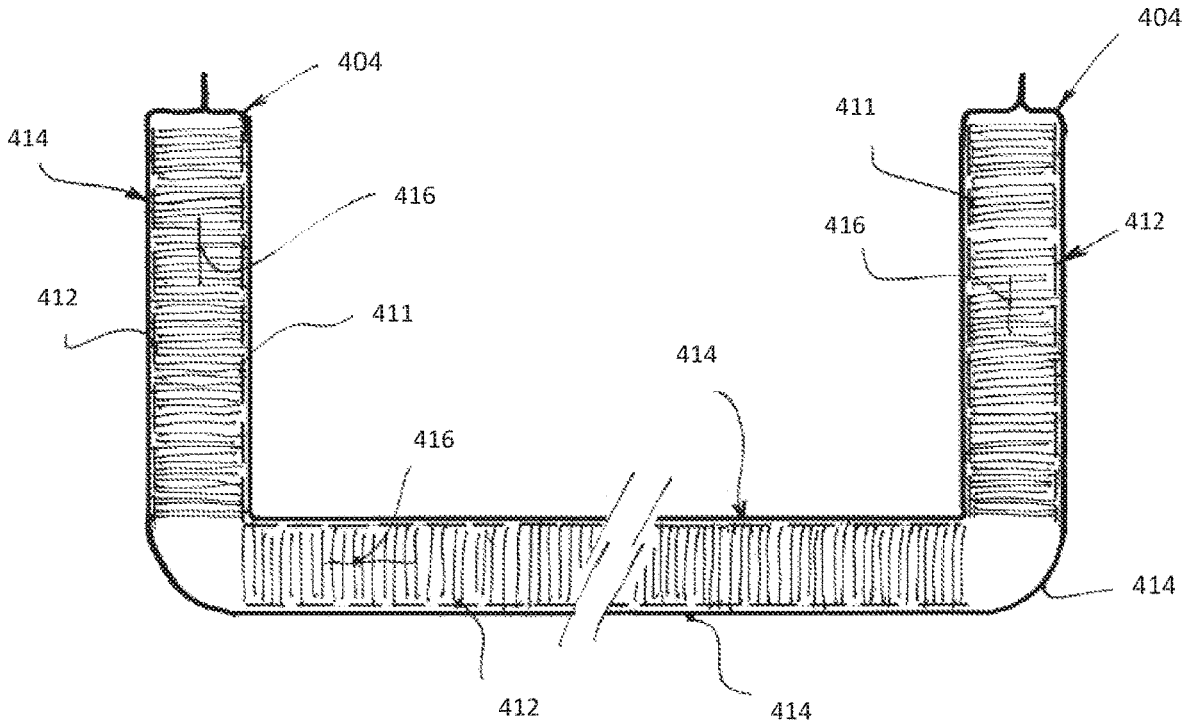

The spacer layer is preferably made from a drop stich material. A wicking layer could also be incorporated to facilitate draw of perspiration and other liquids away from the body of the users. Section A through the mattress 400 of FIG. 9B is shown in FIG. 9C. In FIG. 9C the mattress 400 is inflated and is shown formed from drop stitch material comprising woven top and bottom layers 411 and 412, and a gas impermeable skin 414 bonded to the outer surface of the top and bottom layers 411, 412. Interconnected threads 416 of predetermined length are sandwiched between the top and bottom layers 411, 412.

It is envisaged that in accordance with another embodiment of the invention, the top, middle and bottom panels of the mattress need not necessarily be inflatable, whilst the side panels would be inflatable.

Example 6

Inflatable Mattress and Lifting Device Suitable for Bed/Vehicle Transfer

FIGS. 10 to 20 depict versions of the system readily suitable for lifting a subject from bed and transferring them to the passenger seat of a vehicle. FIG. 10 shows a platform for the lifting system, the platform being in the form of an inflatable mattress 10 with four attachment structures in the form of lateral channels 16 spaced along the length of the mattress 10. The top of the mattress 10 provides the elongate platform surface 101 to support the patient. This platform surface 101 has a back rest portion 50, a seat portion 52 and leg rest portion 54 which dictates the orientation of the deflated mattress 10 when it is folded (or rolled or concertinaed) and laid next to the patient in bed (i.e. the back rest portion 50 adjacent the upper body).

Figure 11:
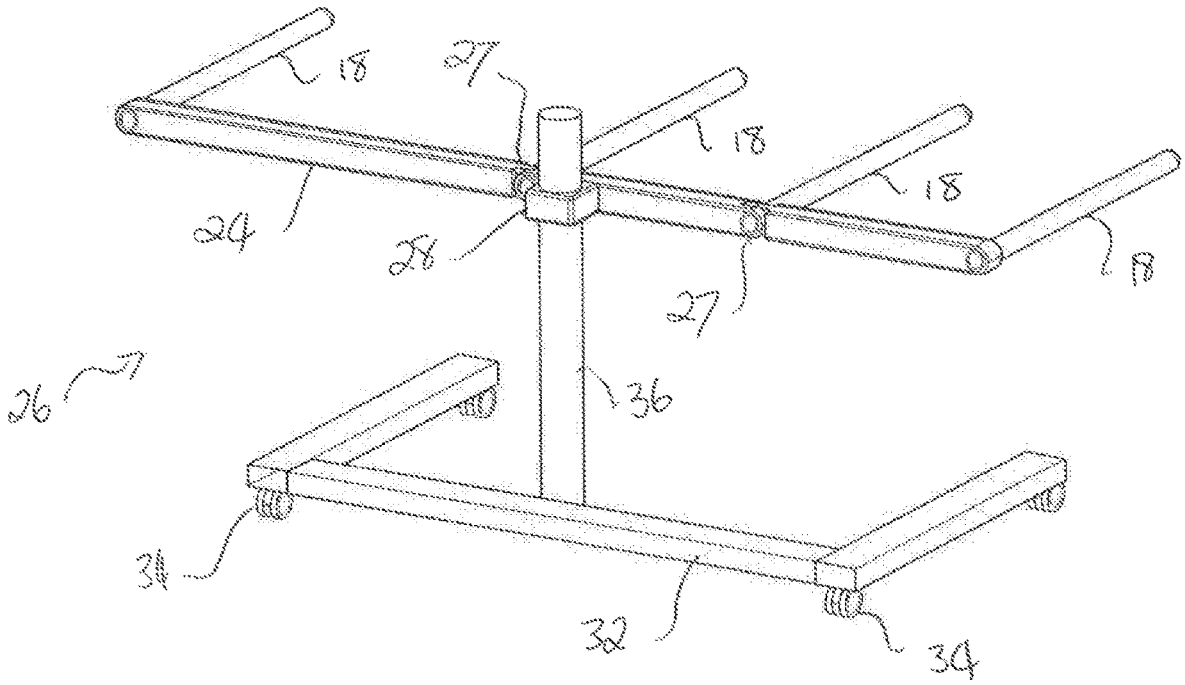
FIG. 11 is a perspective view of a lifting device for the lifting system, the lifting device having four tynes that slide into the lateral channels of the mattress shown in FIG. 10 to lift and lower the mattress while cantilevered from the lifting device.

FIG. 11 shows the lifting device 26 for the lifting system. The lifting device has four cantilevered tynes 18 that slide into the lateral channels 16 of the mattress 10. The tynes 18 are cantilevered from a support frame 24 which in turn is movably mounted to a vertical support 36 via the sleeve 28. The vertical support is rigidly fixed to the lower frame 32 with a broad base for stability and lockable castors 34 for convenient movement. A suitable lift actuator (not shown) acts on the sleeve 28 or other part of the support frame 24 to lift and lower the mattress 10 while cantilevered on the tynes 18. The skilled worker will appreciate suitable lift actuators may be pneumatic, hydraulic, mechanical (e.g. screw thread driven), electrical or combinations of these, and each option will have particular advantages in terms of sophistication and ease of operation as well as varying costs and maintenance complexities. However, the lift actuator selected will need to have a load capacity well in excess of the weight of the patient, and any ancillary equipment they may carry with them.

Figure 12:
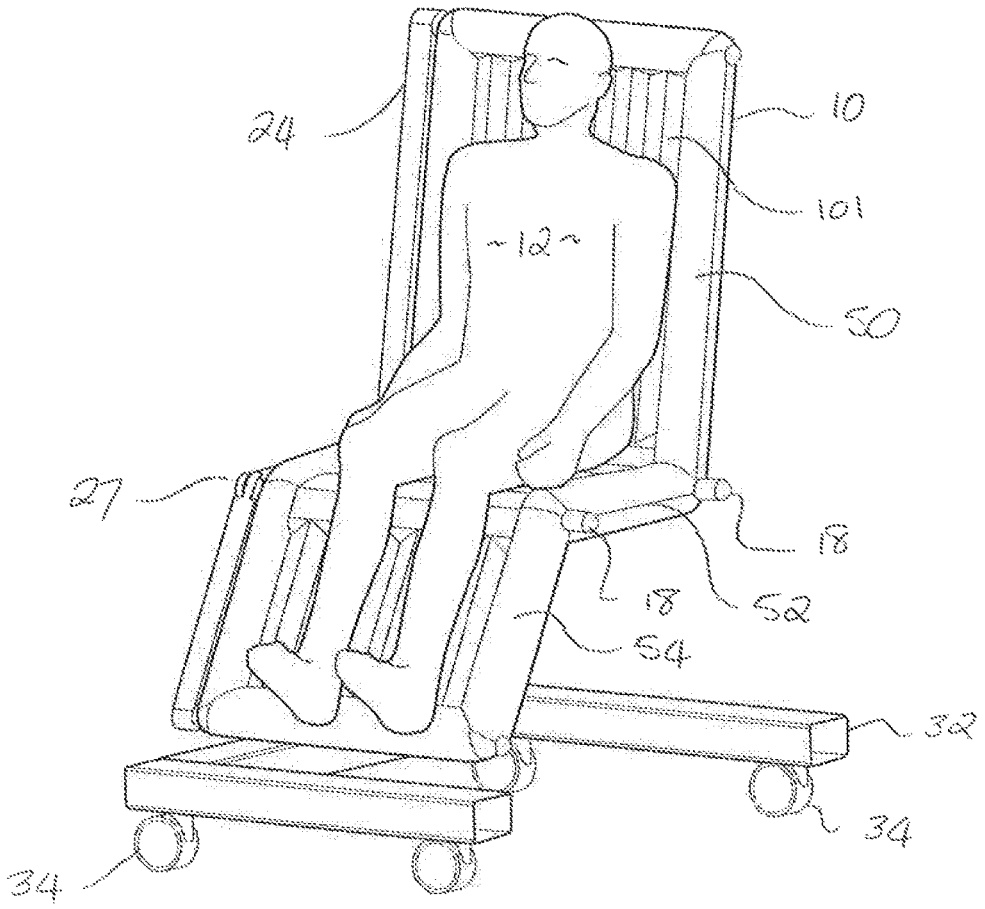
FIG. 12 shows the mattress of FIG. 10 and the lifting device of FIG. 11 interengaged to support a subject in a seated position by positioning the tynes such that the footrest portion, seat portion and backrest portion of the mattress are in a chair configuration.

FIG. 12 shows the mattress 10 being reconfigured by the lifting device 26 to support a subject 12 in a seated position. The support frame 24 has lockable hinges 27 at the cantilevered mounting points for the two inner tynes 18. This allows relative movement of the tynes 18 such that the leg rest portion 54, seat portion 52 and backrest portion 50 of the mattress 10 are in a chair configuration.

Figure 13:
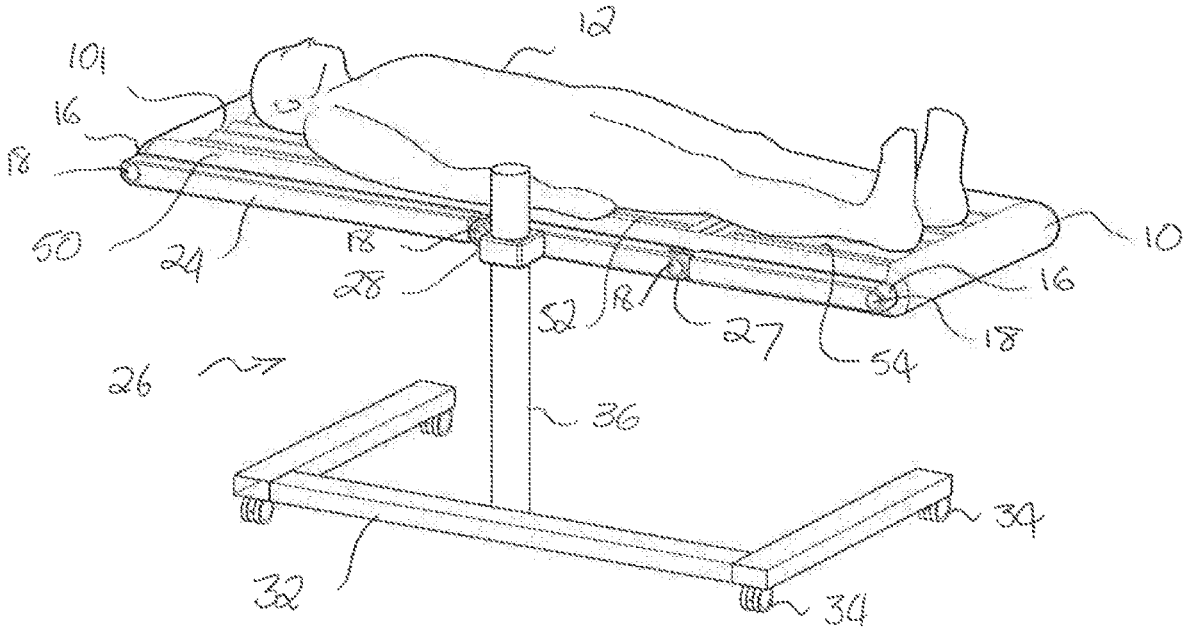
FIG. 13 shows the mattress of FIG. 10 and the lifting device of FIG. 11 interengaged to support a subject in a supine position by positioning the tynes such that the footrest portion, seat portion and backrest portion of the mattress are in a flat configuration.

Similarly, FIG. 13 shows the mattress 10 selectively configured by the lifting device 26 to support the patient 12 in a supine position. The hinges 27 are adjusted and locked to position the tynes 18 such that the leg rest portion 54, seat portion 52 and backrest portion 50 of the platform surface 101 are in a flat configuration.

Figure 14:
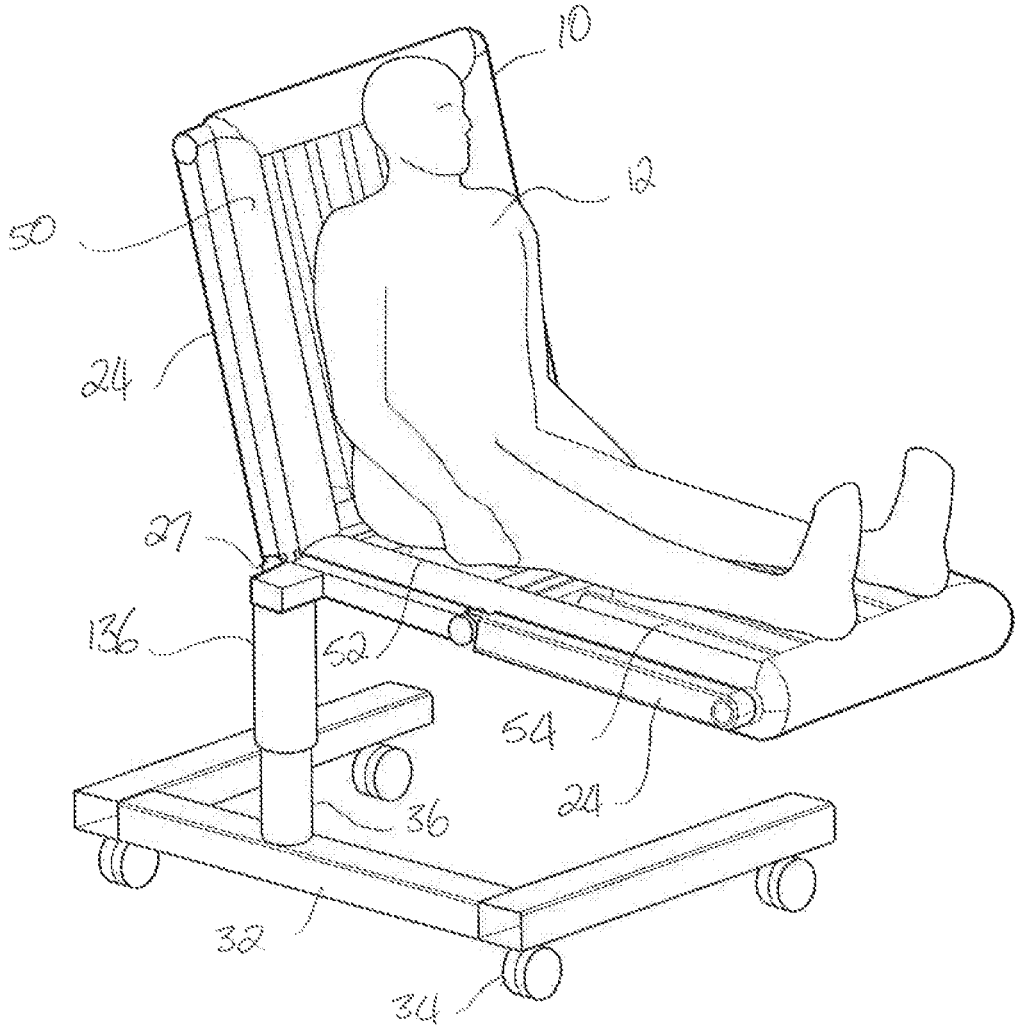
FIG. 14 is a perspective view of the lifting system of FIGS. 10 to 13 reconfigured for supporting a subject in a seated position with legs outstretched.

FIG. 14 shows a further alternative with the patient 12 supported on the mattress 10 in a seated position with legs outstretched. FIG. 14 also shows a form of the support frame 24 with a lift cylinder 136 to telescopically engage the vertical support 36 to hydraulically, pneumatically or electrically lift and lower the support frame 24. The control interface (not shown) may be operated by the patient 12, possible via remote control or personal smart device. More sophisticated versions will provide powered operation of the adjustable/lockable hinges 27 providing the patient 12 with greater levels of autonomy.

Figure 15:
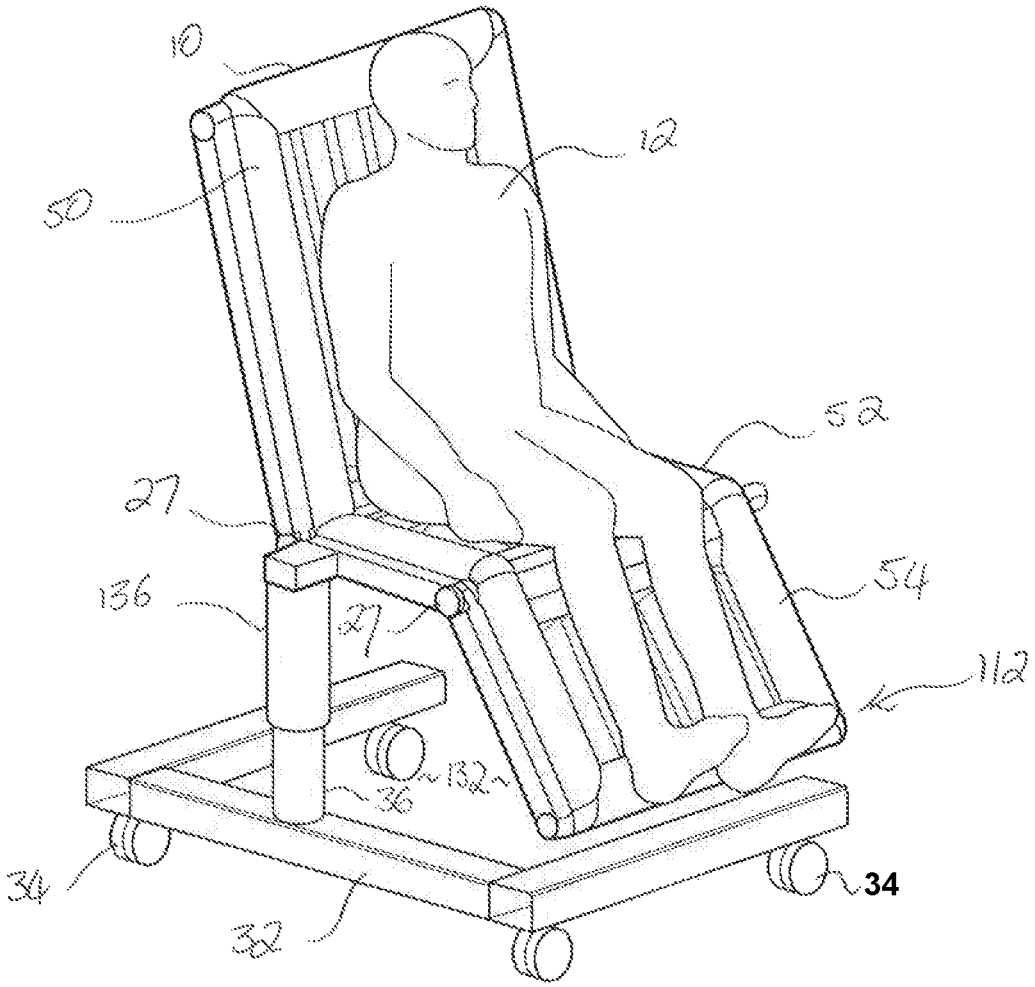
FIG. 15 shows the lifting system of FIG. 12 transitioning from a seated position to an upright configuration to assist the subject to stand.
Figure 17:
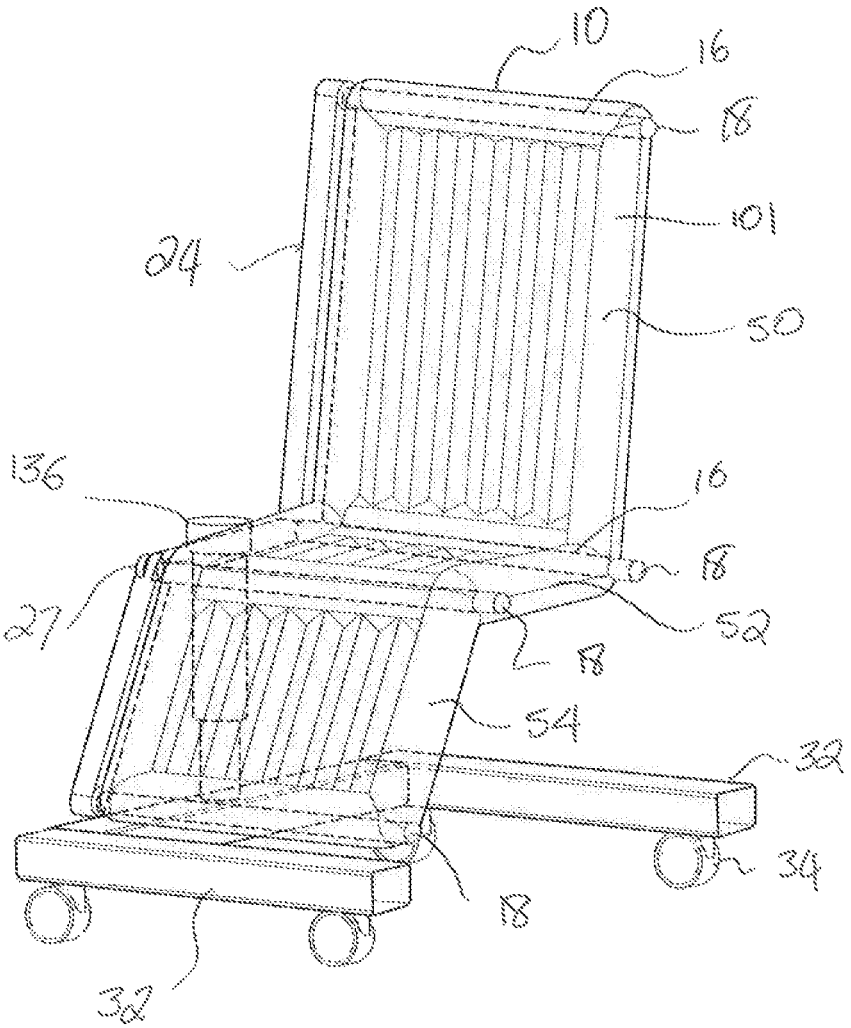
FIG. 17 is a perspective view of the lifting system of FIGS. 10 to 13 with a mattress modified to allow showering or bathing of the subject.

This additional autonomy is beneficial for patients 12 that only require limited assistance. FIG. 15 shows the lifting system being used to transition a patient from a seated position to a standing position. The lift cylinder 136 elevates the support frame 24 and the adjustable hinges 27 move the back rest portion 50, the seat portion 52 and the leg rest 54 guides the patient's feet 112 towards the unobstructed ground 132 within the lower frame 32. With feet on the ground, the patient 12 need only straighten their legs and ease away from the mattress 10 into a standing position. For clarity, FIG. 17 shows the mattress 10 and lifting device 26 of the system interengaged, without the patient, and with the cantilevered tynes 18 shown in ghost line.

Figure 16:
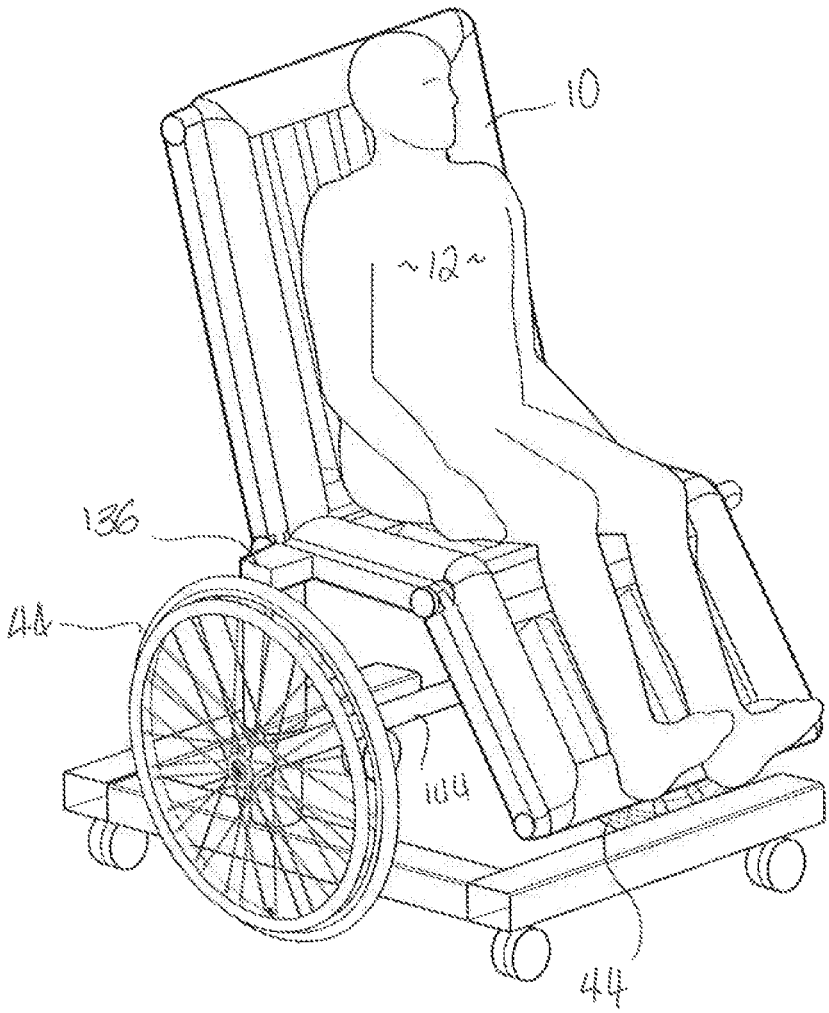
FIG. 16 is a perspective view of the lifting system of FIGS. 10 to 13 modified with wheelchair wheels.

FIG. 16 is an arrangement of the lifting system modified to include wheelchair wheels, similar to the embodiment shown in FIGS. 5A to 5F. The wheelchair wheels 44 can be selectively engaged or disengaged from the ground using the lift cylinder 136 via the wheel axle 144. This provides the patient 12 with the option to self-ambulate and greater independence.

Figure 18:
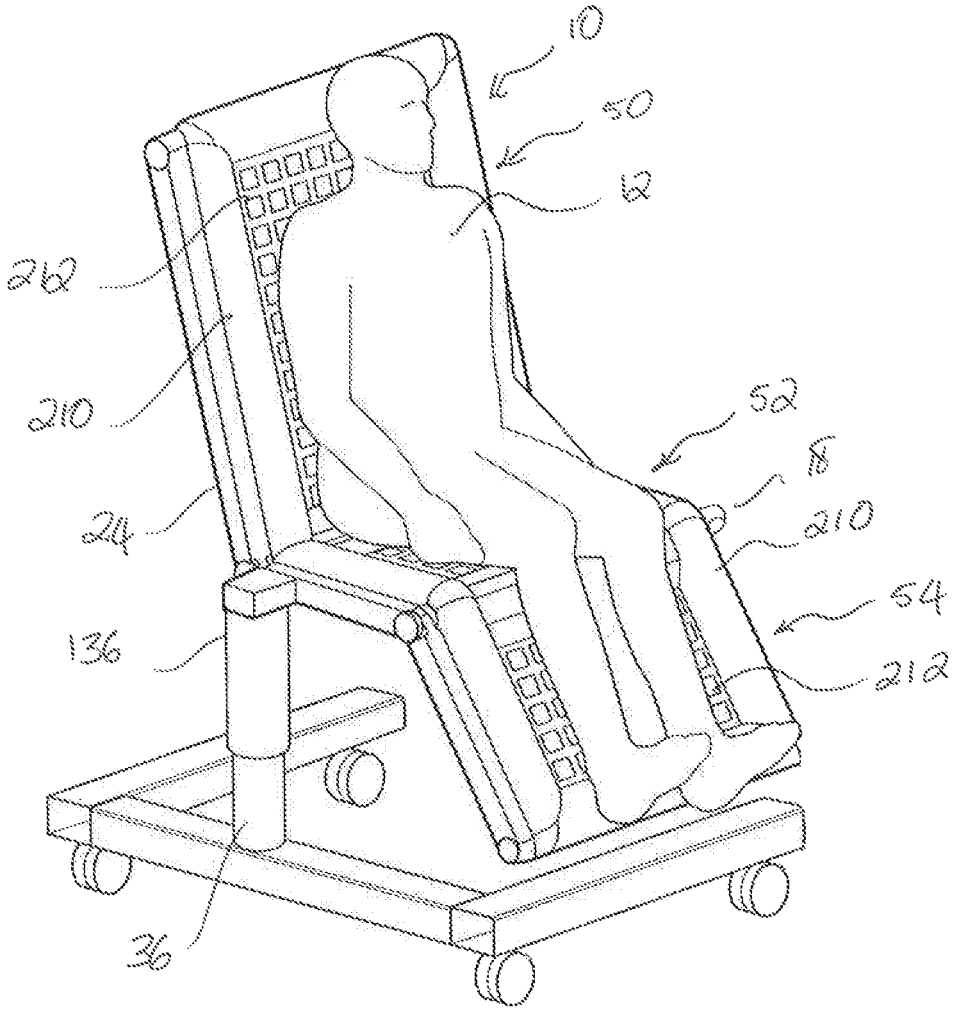
FIG. 18 is a perspective view of the lifting system of FIGS. 10 to 13 with a mattress modified with a mesh panel in the backrest, seat and leg rest portions for showering of the subject.

FIG. 18 is a perspective view of the lifting system with a mattress 10 modified to allow showering or bathing. Similar to the embodiment shown in FIG. 7, the mattress 10 has a back rest portion 50, seat portion 52 and leg rest portion 54 with inflatable peripheries 210. Within the peripheries, is a mesh material 212 for draining water and quick drying to assist with washing the patient 12. The cantilevered tynes 18 still extend through channels 16 (see FIG. 17) defined by the inflatable peripheries 210.

Figure 19:
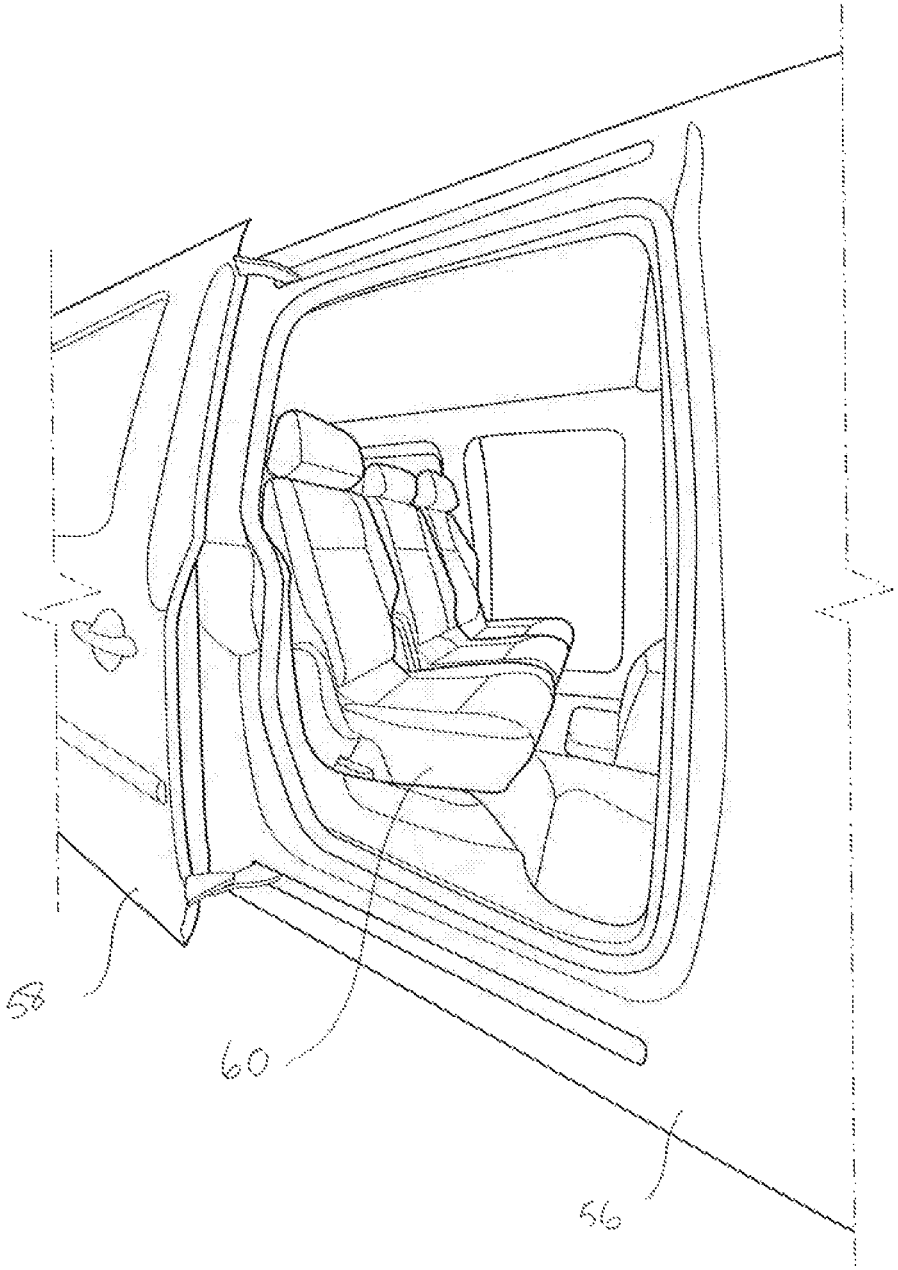
FIG. 19 is an open rear door of a passenger vehicle revealing the rear passenger seats.

FIG. 19 is a passenger vehicle 56 with open side door 58 revealing the rear passenger seats 60. These types of sliding van doors 58 provide good access to the seats and are often preferred for the transport of people with impaired mobility. It will appreciated that the cantilevered support of the mattress 10 by the lifting device 26 is well suited to guiding the patient 12 into the vehicle 56, lowering the mattress 10 onto the seat 60, and simply removing the tynes 18 (from the lifting device 26 or the mattress 10).

Figure 20:
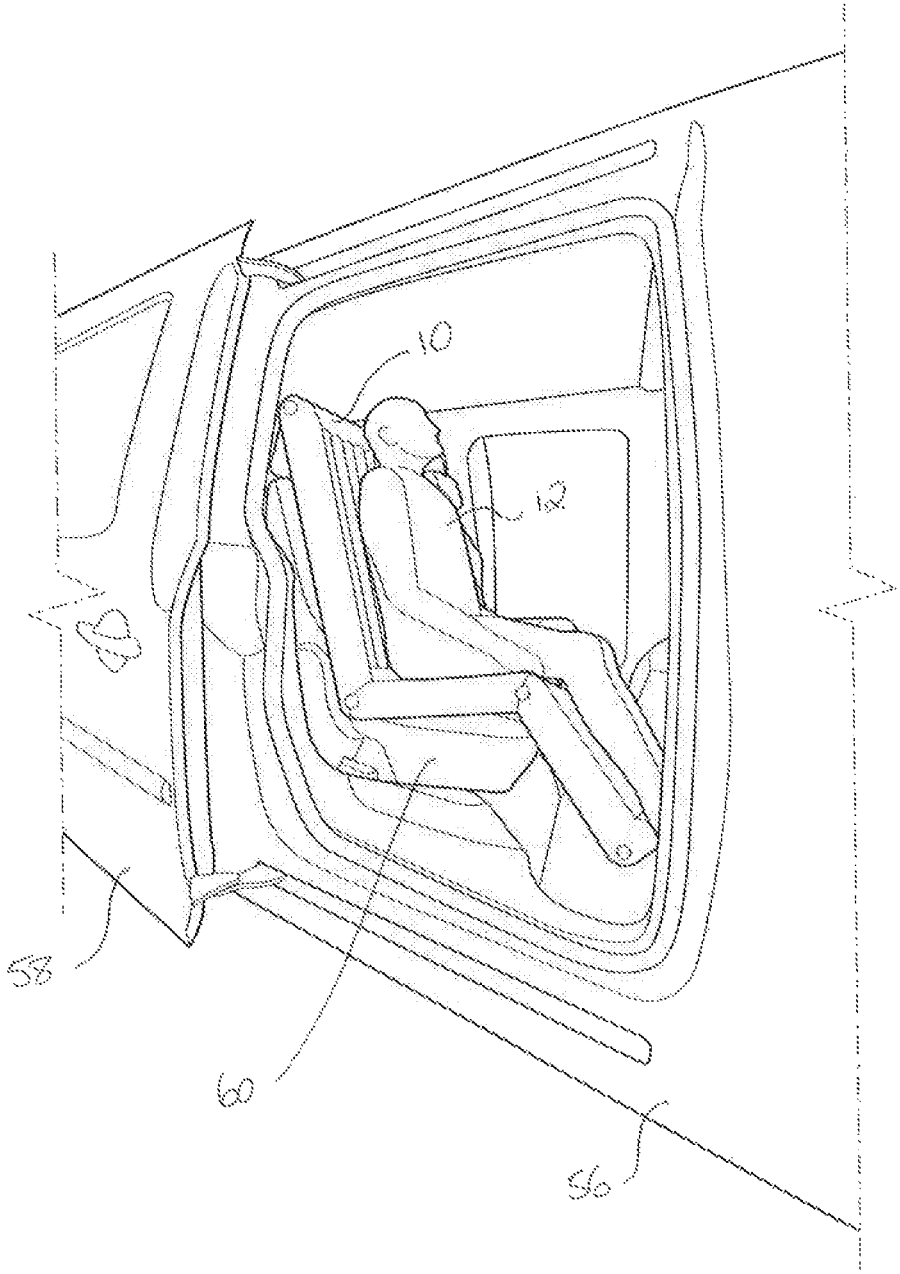
FIG. 20 shows the subject supported on the mattress in the seated position in the rear passenger seat having been lifted into the vehicle by the lifting device of FIGS. 10 to 13.

FIG. 20 shows the subject 12 supported on the mattress 10 in the seated position in the rear passenger seat 60. The inflatable mattress conforms to the contours of the seat and will not obstruct the lap/sash seat belt, or seat belt clasp.

Throughout this specification, unless the context requires otherwise, the word "comprise", or variations such as "comprises" or "comprising", will be understood to imply the inclusion of a stated element or integer or group of elements or integers but not the exclusion of any other element or integer or group of elements or integers.

Also, it must be noted that, as used herein, the singular forms "a", "an" and "the" include plural aspects unless the context already dictates otherwise.

Those skilled in the art will appreciate that the invention described herein is susceptible to variations and modifications other than those specifically described. It is to be understood that the invention includes all such variations and modifications. The invention also includes all of the steps, features, compositions and compounds referred to, or indicated in this specification, individually or collectively, and any and all combinations of any two or more of the steps or features.

Future patent applications may be filed in Australia or overseas on the basis of the present application, for example by claiming priority from the present application, by claiming a divisional status and/or by claiming a continuation status. It is to be understood that the following claims are provided by way of example only, and are not intended to limit the scope of what may be claimed in any such future application. Nor should the claims be considered to limit the understanding of (or exclude other understandings of) the invention or inventions inherent in the present disclosure. Features may be added to or omitted from the example claims at a later date, so as to further define the invention or inventions.

The invention claimed is:

1. A lifting system for lifting a subject supported in a supine lifting position or a seated lifting position, the lifting system comprising:

an elongate platform for supporting the subject, the platform having a backrest portion, a seat portion, and a longitudinal axis extending through the backrest and seat portions, wherein the backrest portion and the seat portion are generally coplanar for supporting the subject in the supine lifting position, wherein the backrest portion and the seat portion are angled to each other for supporting the subject in the seated lifting position, wherein the platform is selectively configurable in a flexible state allowing the platform to fold along the longitudinal axis for positioning the platform beneath the subject and a rigid state to support the subject in the supine lifting position or the seated lifting position, and wherein the platform further includes a plurality of attachment structures; and a lifting device having a plurality of spaced apart cantilevered tynes for detachably engaging the attachment structures of the platform to elevate and lower the platform cantilevered from the lifting device, wherein the lifting device is operable to (a) selectively lock the tynes in fixed positions relative to one another and (b) move the tynes to change positions relative to one another to move the platform between the supine lifting position and the seated lifting position.

2. A lifting system according to claim 1 wherein, the platform has at least one inflatable compartment such that the platform is in the flexible state when the platform is deflated and in the rigid state when the platform is inflated.

3. A lifting system according to claim 1 wherein, the platform has support elements configured such that at least one support element selectively engages at least one other support element when the platform is in the rigid state to structurally strengthen the platform, and disengage when the platform is in the flexible state such that the support elements are movable relative to each other.

4. A lifting system according to claim 3 wherein relative movement of the support elements causes the platform to change between the flexible state and the rigid state.

5. A lifting system according to claim 1 wherein, the platform has at least one inflatable compartment such that the platform is in the flexible state when the platform is deflated and in the rigid state when the platform is inflated, the platform has support elements configured such that at least one support element selectively engages at least one other support element when the platform is in the rigid state to structurally strengthen the platform, and disengage when the platform is in the flexible state such that the support elements are movable relative to each other, and one or more of the support elements are within one of the inflatable compartments.

6. A lifting system according to claim 2 wherein, the inflatable compartments are formed from drop stitch material with a woven top layer overlaying a woven bottom layer with a multitude of interconnecting threads of predetermined length sandwiched between the top layer and the bottom layer, and a gas impermeable skin bonded to the outer of the top and bottom layers, the skin also forming side walls of a height generally corresponding to the length of the interconnecting threads such that inflation of the inflatable compartments rigidly fixes the top layer relative to the bottom layer in accordance with the lengths of the interconnecting threads.

7. A lifting system according to claim 1, wherein the lifting device is controlled by technology developed for people with disabilities.

8. A lifting system according to claim 7 wherein the technology accepts user inputs including one or more of the following:

eye gaze,
breath control,
voice recognition, and
joystick.

9. A lifting system according to claim 1 wherein the lifting device has four tynes and the platform further includes a leg rest portion extending from the seat portion, wherein the backrest portion extends between two of the four tynes when engaged with the lifting device, the leg rest portion extends between the remaining two tynes, and the seat portion extends between the back rest portion and the leg rest portion, such that during use the back rest portion, the seat portion and the leg rest portion are angularly displaceable relative to each other by relative movement of the four tynes.

10. A lifting system for lifting a subject supported in a desired position, the lifting system comprising:

an elongate platform for supporting the subject, the platform having a longitudinal axis and being selectively configurable in a flexible state allowing the platform to fold along the longitudinal axis for positioning the platform beneath the subject, and a rigid state to support the subject in the desired position, the platform also having one or more attachment structures; and a lifting device for detachably engaging the one or more attachment structures to elevate and lower the platform cantilevered from the lifting device, wherein, the lifting device has four tynes and the platform has a backrest portion, a seat portion and a leg rest portion, wherein the backrest portion extends between two of the four tynes when engaged with the lifting device, the leg rest portion extends between the remaining two tynes, and the seat portion extends between the back rest portion and the leg rest portion, such that during use the back rest portion, seat portion and leg rest portion are angularly displaceable relative to each other by relative movement of the four tynes.

11. A method of lifting a subject supported in a supine lifting position or a seated lifting position, the method comprising:

providing an elongate platform for supporting the subject, the platform having a backrest portion, a seat portion, and a plurality of attachment structures, wherein the platform is selectively configurable in a flexible state allowing the backrest portion and the seat portion to fold about a longitudinal axis extending through the backrest portion and the seat portion, and a rigid state to support the subject in the supine lifting position or the seated lifting position;

positioning the subject to lie on one side;

positioning the platform in a flexible state alongside the subject so that the backrest portion and the seat portion are generally coplanar;

folding the platform and placing the platform such that the fold is closely adjacent the subject's back;

rolling the subject to their opposing side onto the platform;

unfolding the platform such that the platform extends beneath the subject;

configuring the platform into the rigid state;

detachably engaging the attachment structures with cantilevered tynes of a lifting device;

lifting the tynes to elevate and lower the platform cantilevered from the lifting device; and moving the platform at least partially between the supine lifting position and the seated lifting position by moving at least some of the tynes relative to one another.

12. A method according to claim 11 wherein the platform has at least one inflatable compartment such that configuring the platform in the flexible state involves deflating the compartment and configuring the platform in the rigid state involves inflating the compartment.

* * * * *